US012311214B2

(12) United States Patent
Mooney et al.

(10) Patent No.: US 12,311,214 B2
(45) Date of Patent: May 27, 2025

(54) RESISTANCE TRAINING MACHINE AND METHODS OF USE

(71) Applicant: Speede Fitness, LLC, Lake Zurich, IL (US)

(72) Inventors: Daniel Mooney, Lake Zurich, IL (US); Gregory Tepas, Barrington, IL (US)

(73) Assignee: Speede Fitness, LLC, Lake Zurich, IL (US)

( * ) Notice: Subject to any disclaimer, the term of this patent is extended or adjusted under 35 U.S.C. 154(b) by 0 days.

(21) Appl. No.: 18/641,846

(22) PCT Filed: Oct. 21, 2022

(86) PCT No.: PCT/US2022/047441
§ 371 (c)(1),
(2) Date: Apr. 22, 2024

(87) PCT Pub. No.: WO2023/069724
PCT Pub. Date: Apr. 27, 2023

(65) Prior Publication Data

US 2025/0041647 A1 Feb. 6, 2025

Related U.S. Application Data

(60) Provisional application No. 63/346,800, filed on May 27, 2022, provisional application No. 63/270,408, filed on Oct. 21, 2021.

(51) Int. Cl.
*A63B 21/005* (2006.01)
*A63B 21/00* (2006.01)
(Continued)

(52) U.S. Cl.
CPC ..... *A63B 21/0058* (2013.01); *A63B 21/153* (2013.01); *A63B 21/4029* (2015.10);
(Continued)

(58) Field of Classification Search
CPC ..... A63B 21/4029; A63B 21/153; A63B 21/0058; A63B 71/0619;
(Continued)

(56) References Cited

U.S. PATENT DOCUMENTS 6,280,361 B1 * 8/2001 Harvey ..... A63B 24/00 482/4
6,652,429 B2 11/2003 Bushnell
(Continued)

FOREIGN PATENT DOCUMENTS

KR 20230153121 A * 11/2023 ..... A63B 21/0058
WO WO-2022212737 A1 * 10/2022 ..... A63B 21/00069

OTHER PUBLICATIONS

US 10,279,209 B2, 05/2019, Orady et al. (withdrawn)
(Continued)

*Primary Examiner* — Megan Anderson
*Assistant Examiner* — Jonathan A Dicuia
(74) *Attorney, Agent, or Firm* — J. Peter Paredes; Amin Wasserman Gurnani LLP

(57) ABSTRACT

A resistance training machine, a method of providing custom workouts, and a method of providing feedback on user form and user balance are disclosed. The resistance training machine includes a left and right motor, a left and right pulley system, a left and right cable, a machine controller, and a human machine interface. Advantageously, the resistance training machine can provide isotonic exercises, isokinetic exercises, and feedback on form and balance for a user. The first method includes a user calibrating one or more exercises, selecting an exercise, selecting an exercise mode, and performing the exercise. For each exercise, a motor may ramp up to and ramp down from a selected velocity or force level.

17 Claims, 20 Drawing Sheets

(51) Int. Cl.
*A63B 24/00* (2006.01)
*A63B 71/06* (2006.01)

(52) U.S. Cl.
CPC ..... *A63B 24/0087* (2013.01); *A63B 71/0619* (2013.01); *A63B 2024/0093* (2013.01); *A63B 2071/0652* (2013.01); *A63B 2225/50* (2013.01)

(58) Field of Classification Search
CPC .... A63B 2071/0652; A63B 2024/0093; A63B 2225/50; A63B 24/0087
See application file for complete search history.

(56) References Cited

U.S. PATENT DOCUMENTS 7,717,824 B2 5/2010 Pinto
7,874,957 B2 1/2011 Hurwitz et al.
8,105,206 B2 1/2012 Rindfleisch
8,118,710 B2 2/2012 Weinman et al.
8,328,691 B2 12/2012 Lanfermann et al.
8,388,499 B1 3/2013 Rindfleisch
8,475,338 B2 7/2013 Greenhill et al.
8,613,689 B2 12/2013 Dyer et al.
8,663,068 B1 3/2014 Dyer et al.
8,727,946 B2 5/2014 Greenhill et al.
8,827,870 B2 9/2014 Dyer et al.
8,911,328 B2 12/2014 Alessandri et al.
9,061,170 B2 6/2015 Alessandri et al.
9,095,492 B2 8/2015 Verkaaik et al.
9,403,047 B2 8/2016 Olson et al.
9,409,053 B1 8/2016 Todd
9,474,935 B2 10/2016 Abbondanza et al.
9,539,458 B1 1/2017 Ross
9,636,543 B2 5/2017 Dyer et al.
9,694,229 B2 7/2017 Taft
9,707,435 B1 7/2017 Ferlito et al.
9,814,920 B1 7/2017 Monterrey
9,757,605 B2 9/2017 Olson et al.
9,821,191 B2 11/2017 Abbondanza et al.
9,968,816 B2 5/2018 Olson et al.
10,099,085 B2 10/2018 Skinner et al.
10,118,073 B2 11/2018 Wicks et al.
10,188,890 B2 1/2019 Olson et al.
10,190,682 B2 1/2019 Paisley et al.
10,265,567 B2 4/2019 Wilt
10,335,626 B2 7/2019 Orady et al.
10,589,163 B2 3/2020 Orady et al.
10,603,535 B2 3/2020 Alexander et al.
10,617,903 B2 4/2020 Orady et al.
10,617,904 B2 4/2020 Chiavegato et al.
10,709,932 B2 7/2020 Herring
10,758,767 B2 9/2020 Olson et al.
10,765,914 B1 9/2020 Trexler
10,792,539 B1 10/2020 Gilstrom et al.
10,814,172 B1 10/2020 Ilfrey et al.
10,821,323 B2 11/2020 Abbondanza et al.
10,828,531 B1 11/2020 Smith et al.
10,850,162 B2 12/2020 Wicks et al.
10,881,890 B2 1/2021 Orady et al.
10,960,266 B2 3/2021 Messinger
10,967,214 B1 4/2021 Olson et al.
10,987,538 B2 4/2021 Fowler
11,040,231 B2 6/2021 Rubin et al.
11,052,279 B1 7/2021 Vujicic et al.
11,077,330 B2 8/2021 Orady et al.
11,123,592 B2 9/2021 Orady et al.
11,123,609 B2 9/2021 Rubin et al.
11,161,004 B2 11/2021 Lee
11,161,012 B1 11/2021 Hendricks et al.
11,351,409 B2 6/2022 Alexander et al.
11,452,908 B1 9/2022 Eilers et al.
11,572,947 B2 2/2023 Enot et al.
12,036,444 B2 * 7/2024 Neuhaus ..... A63B 24/0075
2002/0025888 A1 2/2002 Germanton et al.
2007/0155587 A1 7/2007 Huang et al.
2007/0249468 A1 10/2007 Chen
2011/0152045 A1 6/2011 Horne
2012/0065034 A1 3/2012 Loach
2014/0315688 A1 10/2014 Weinman et al.
2014/0315689 A1 10/2014 Vauquelin et al.
2014/0336015 A1 11/2014 Forsyth
2017/0319941 A1 11/2017 Smith et al.
2018/0326241 A1 11/2018 Huskins et al.
2018/0339195 A1 11/2018 Bernotas
2019/0046830 A1 2/2019 Chiavegato et al.
2019/0344115 A1 11/2019 Neuhaus et al.
2020/0222266 A1 7/2020 Gordon et al.
2020/0254295 A1 8/2020 Watterson
2020/0342975 A1 10/2020 Bengtsson et al.
2020/0391069 A1 12/2020 Olson et al.
2020/0391080 A1 12/2020 Powers et al.
2021/0008401 A1 1/2021 Orady et al.
2021/0060378 A1 3/2021 Smith et al.
2021/0128978 A1 5/2021 Gilstrom et al.
2021/0154531 A1 5/2021 Gilstrom et al.
2021/0195842 A1 7/2021 Williams
2021/0236874 A1 * 8/2021 Ward ..... A63B 24/0087
2022/0118304 A1 4/2022 McNally et al.
2022/0233907 A1 * 7/2022 Cobb ..... A63B 71/0622
2022/0258006 A1 8/2022 Norris
2022/0410361 A1 12/2022 Hallberg et al.
2023/0001259 A1 1/2023 Simenthi
2023/0009699 A1 * 1/2023 Ferlito ..... A63B 21/0552

OTHER PUBLICATIONS

WIPO/ISA/US, International Search Report and Written Opinion for corresponding application PPCT/US2022/047441 dated Feb. 3, 2023, 7 pages.

* cited by examiner

| | |
|---|---|
| Dimensions | 60mm (2.36") Diameter x 81mm (3.18") Long |
| Volume | 199.54 $cm^3$ (12.17 $in^3$) |
| Weight | 1.1 lbs (0.49kg) |
| Output Shaft | 14T, 0.5 Module Spline Shaft |
| Free Speed RPM | 6380 RPM |
| Free Current | 1.5A |
| Power @ 40A/ 12VDC | 400W (83% Efficient) |
| Peak Efficiency | 87% (294W In) |
| Peak Power | 783W |
| Stall Torque | 4.69Nm |
| Stall Current | 257A |

FIG. 5

RESISTANCE TRAINING MACHINE AND METHODS OF USE

CROSS-REFERENCE TO RELATED APPLICATIONS

The present application claims priority to PCT application serial no. PCT/US2022/047441, filed Oct. 21, 2022, which claims priority to U.S. provisional application Ser. No. 63/270,408, filed Oct. 21, 2021 and U.S. Provisional application Ser. No. 63/346,800, filed May 27, 2022, each herein incorporated by reference in their entireties.

TECHNICAL FIELD

The present disclosure generally relates to exercise equipment and, more specifically, to resistance training machines employing electric motors to provide custom workouts.

BACKGROUND

Resistance training is a form of exercise undergone to build muscular strength and endurance by working against a weight or applied force. While some resistance training routines can be accomplished without external equipment, i.e. bodyweight exercises, many others require the use of specialized equipment, such as but not limited to free weights, weight machines, cable machines, resistance bands, and the like.

Traditional resistance training equipment is often specialized and, while each piece of equipment may offer distinct advantages, each may also suffer from drawbacks and inefficiencies. For example, free weights and weight machines are commonly employed for isotonic exercises, i.e. exercises requiring muscle activation against a constant force across a given range of motion. However, adjusting the weight or force for such exercises can be inconvenient, often requiring a user to add or remove plates, install clips, swap out dumbbells, etc. Furthermore, initiating an exercise with free weights and weight machines can create undue strain on a user's body, since the force applied by such equipment acts as a step function-jumping from zero to the full resistance. Perhaps more importantly, traditional resistance training equipment is usually designed for specific exercises or specific exercise modes only, requiring an individual to own a plurality of equipment in order to access a variety of well-rounded exercises.

More recently, 'smart' exercise machines have been developed that claim to offer a number of different exercises in a single machine. These machines commonly operate by providing resistive forces through electronic motors, which may be adjusted to the user's strength level. However, the exercise machines disclosed by the prior art have consistently failed to provide a range of exercise modes, or can provide some modes but fail in others. Moreover, such machines tend to be limited in the amount of force they produce; they are usually unwieldy and difficult to install or transport; and many fail to provide adequate safety measures for the user. Finally, neither traditional resistance training equipment nor newer exercise machines offer feedback regarding both user form and user balance during workouts.

Accordingly, there remains a need in the art for a resistance training machine that is capable of implementing a large number of exercise modes, including at least isotonic and isokinetic exercises; that is capable of supplying high levels of resistive force; and that may provide feedback on user form and user balance throughout each exercise.

SUMMARY OF THE DISCLOSURE

According to a first aspect of the present disclosure, a resistance training machine is disclosed. The resistance training machine may comprise a base situated substantially parallel to the floor; a power supply; a left motor and a right motor, each including an integrated motor encoder and an integrated motor controller; a left pulley system configured to operatively convert torque from the left motor to a constant force or a constant velocity; a right pulley system configured to operatively convert torque from the right motor to a constant force or a constant velocity; a left cable operatively coupled to the left motor and running through the left pulley system; a right cable operatively coupled to the right motor and running through the right pulley system; a machine controller configured to control the left motor and the right motor and to receive position and torque feedback therefrom; and an HMI in bi-directional communication with the machine controller. The resistance training machine can provide isotonic exercises in the constant force, isokinetic exercises in the constant velocity, and can communicate user form feedback and user balance feedback.

According to a second aspect of the present disclosure, a method of providing custom workouts using a resistance training machine is disclosed. The method comprises: calibrating one or more exercises, each exercise including a relative beginning position and a relative end position; the user selecting an exercise from among the one or more calibrated exercises; the user selecting an isokinetic exercise mode or an isotonic exercise mode; the user moving a cable to a beginning position without resistance; a motor ramping up the cable to a constant velocity or a constant force, depending on the exercise mode; the user performing one or more repetitions of the exercise; and the motor ramping down the cable from the constant velocity or the constant force, depending on the exercise mode.

According to a third aspect of the present disclosure, a method of providing feedback on user form and user balance during an exercise on a resistance training machine is disclosed. The method comprises: a user performing an isokinetic exercise or an isotonic exercise using resistance supplied by a motor; a machine controller receiving position data from the motor throughout the exercise; the machine controller receiving torque data from the motor throughout the exercise; the machine controller receiving force data from one or more load cells located in a base of the resistance training machine; the machine controller generating user form feedback; the machine controller generating user balance feedback; and displaying the user form feedback and user balance feedback through an HMI.

These and other aspects and features of the present disclosure will be more readily understood after reading the following description in conjunction with the accompanying drawings.

BRIEF DESCRIPTION OF THE DRAWINGS

FIG. 5 is a table showing exemplary specifications for the motors of the resistance training machine according to another embodiment of the present disclosure.

DETAILED DESCRIPTION

Figure 1:
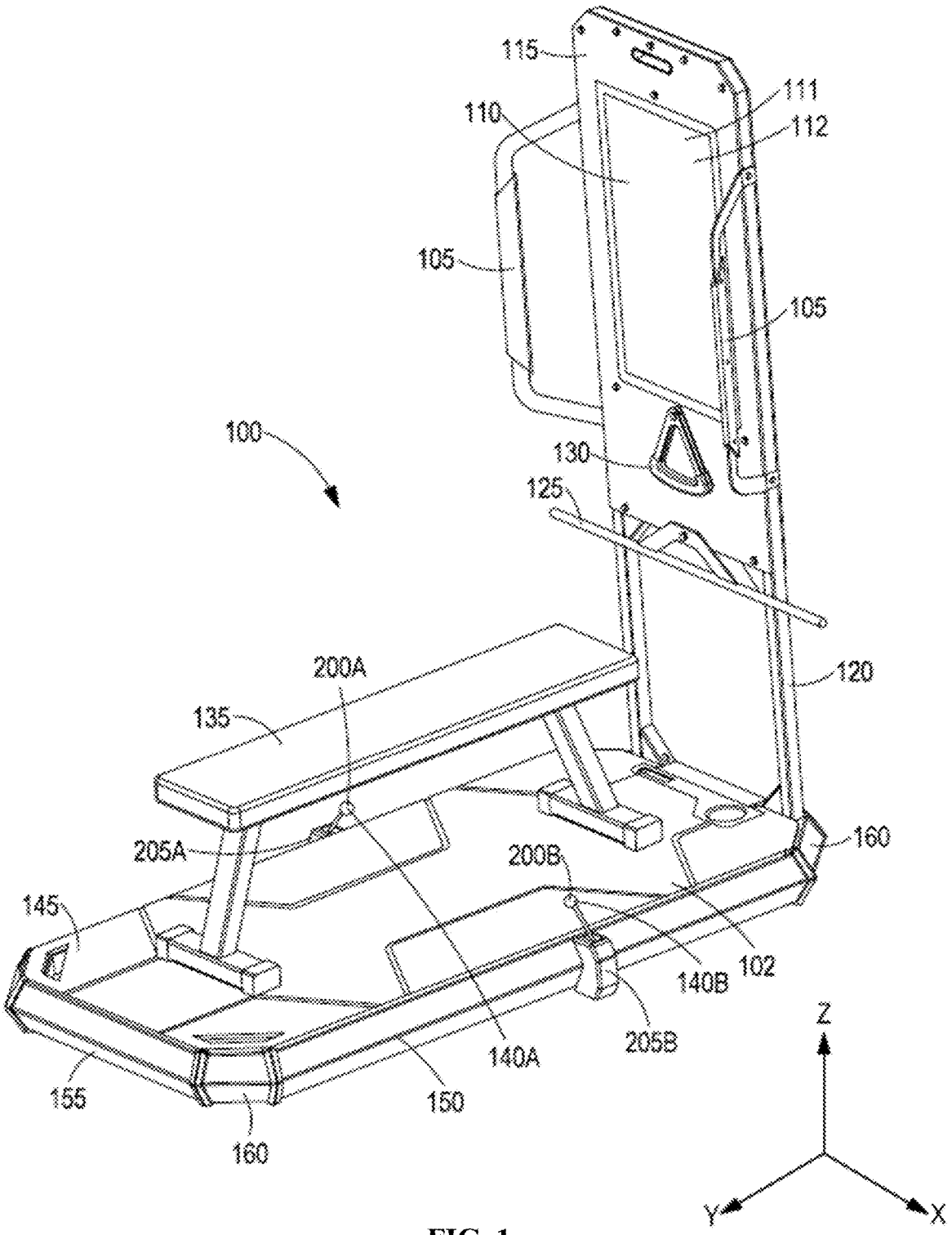
FIG. 1 is a schematic of a resistance training machine according to an embodiment of the present disclosure.

Referring now to the drawings and with specific reference to FIG. 1, a diagram of a resistance training machine is generally referred to by a reference numeral 100. The resistance training machine 100 may be situated in a home, apartment, hotel, commercial gym, and the like, and may be capable of enabling both isotonic exercises and isokinetic exercises at varying force and velocity levels, respectively, for a user. Furthermore, the resistance training machine may measure and communicate form feedback and balance feedback during some or all exercises performed on the machine 100, thereby improving workout efficacy and safety for the user. As seen in FIG. 1, the machine 100 may comprise at least a base 102, a left cable 140A, a right cable 140B, and a human-machine interface (HMI) 110. In another possible embodiment, shown in FIG. 8, the resistance training machine 100 may comprise the base 102, including a front section 1021, a middle section 1022, and a rear section 1023. An electromagnetic assembly (EM) 103 may be attached to the front section 1021, and a front upright stand 115 may be attached to and extend vertically from the EM assembly 103.

Figure 2:
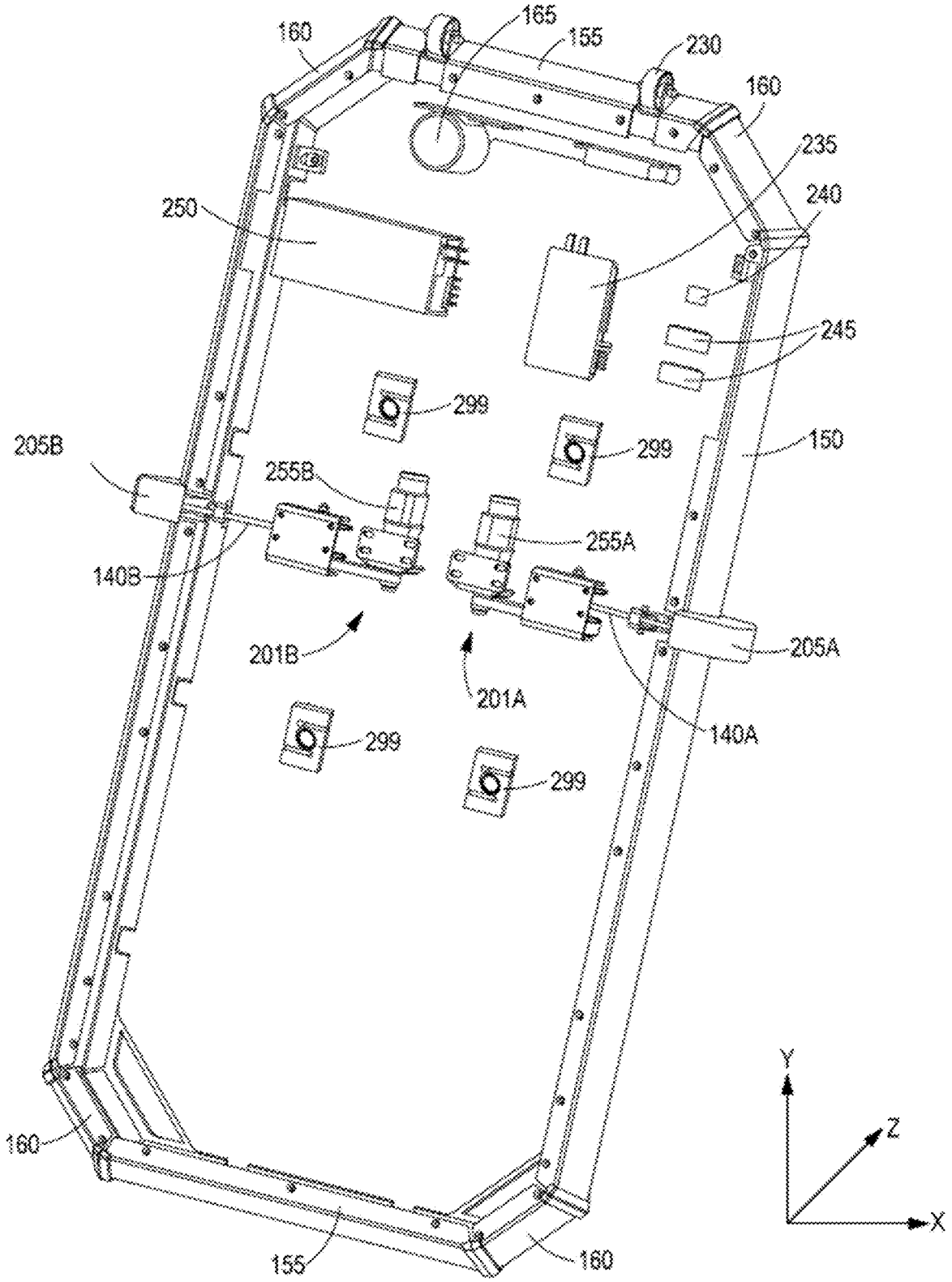
FIG. 2 is a cut-away schematic of a base of the resistance training machine according to another embodiment of the present disclosure.

Turning now to FIG. 2, a cut-away schematic of the base 102 of the resistance training machine 100 is provided, as viewed from the bottom up. In particular, the machine 100 may comprise a power supply 235, a left motor 255A, a right motor 255B, a left pulley system 201A, a right pulley system 201B, a left cable 140A, a right cable 140B, a machine controller 250, and one or more load cells 299. While each of the above components are located within the base 102 in FIG. 2, in other embodiments, some or all of the above components may be placed elsewhere in the machine 100. For example, in an embodiment shown in FIG. 8, each of the power supply 235, motors 255, and machine controller 250 may be located in the EM assembly 103, and the pulley systems 201 may be located in both the EM assembly 103 and the base 102. No limitation is intended herein for the precise placement of the components of the machine 100, which may include any combination of locations in the base 102, EM assembly 103, and front upright stand 115.

The power supply 235 may receive electrical power from an external supply and may provide electrical power to some or all of the other electronic components of the machine 100, where wattage ratings may be determined by specific applicational requirements. In some embodiments, such as the one shown in FIG. 2, each of the aforementioned motors, pulley systems, and cables may be substantially mirrored across a central plane (defined by the Y-axis and Z-axis) of the machine 100. In other embodiments, however, the left elements and the right elements may necessarily be symmetrical, and may be offset with respect to the X-axis, Y-axis, or Z-axis, depending on specific applicational requirements. Regardless, for ease of clarity, the following discussion with respect to the right elements of the machine 100 may be analogously applied to their left counterparts.

As seen in FIG. 2, the right pulley system 201B may be configured to operatively convert a torque outputted by the right motor 255B to a vertical (Z-axis) force vector, i.e. a force vector having a non-zero vertical (Z-axis) component. Associated with the right pulley system 201B is the right cable 140B, which may be operatively, but not necessarily directly, coupled to the right motor 255B at a first end, and which may run through the right pulley system 201B. In other words, a torque generated by the right motor 255B may be operatively converted into tension in the right cable 140B through the right pulley system 201B. As previously discussed, an analogous configuration may be applied to the left motor 255A, left pulley system 201A, and left cable 140A.

Returning to FIG. 1, it may be appreciated that the base 102 is situated substantially parallel to the floor. Consequently, a "docking position" or position of maximum retraction for either cable 140 may be its lowest possible position with respect to the Z-axis. A knob 200 may define an endpoint for each cable 140 and may prevent further retraction into a pulley housing 205, which will be discussed in greater detail below. In some embodiments, the machine 100 may further comprise one or more adjustable legs, pegs, or the like (not shown), which extend from the bottom of the base 102 and which adjust a height, angle, and/or level of the base 102 with respect to the floor. The base includes side base frame member covers 150 and corner base frame member covers 160.

Figure 9:
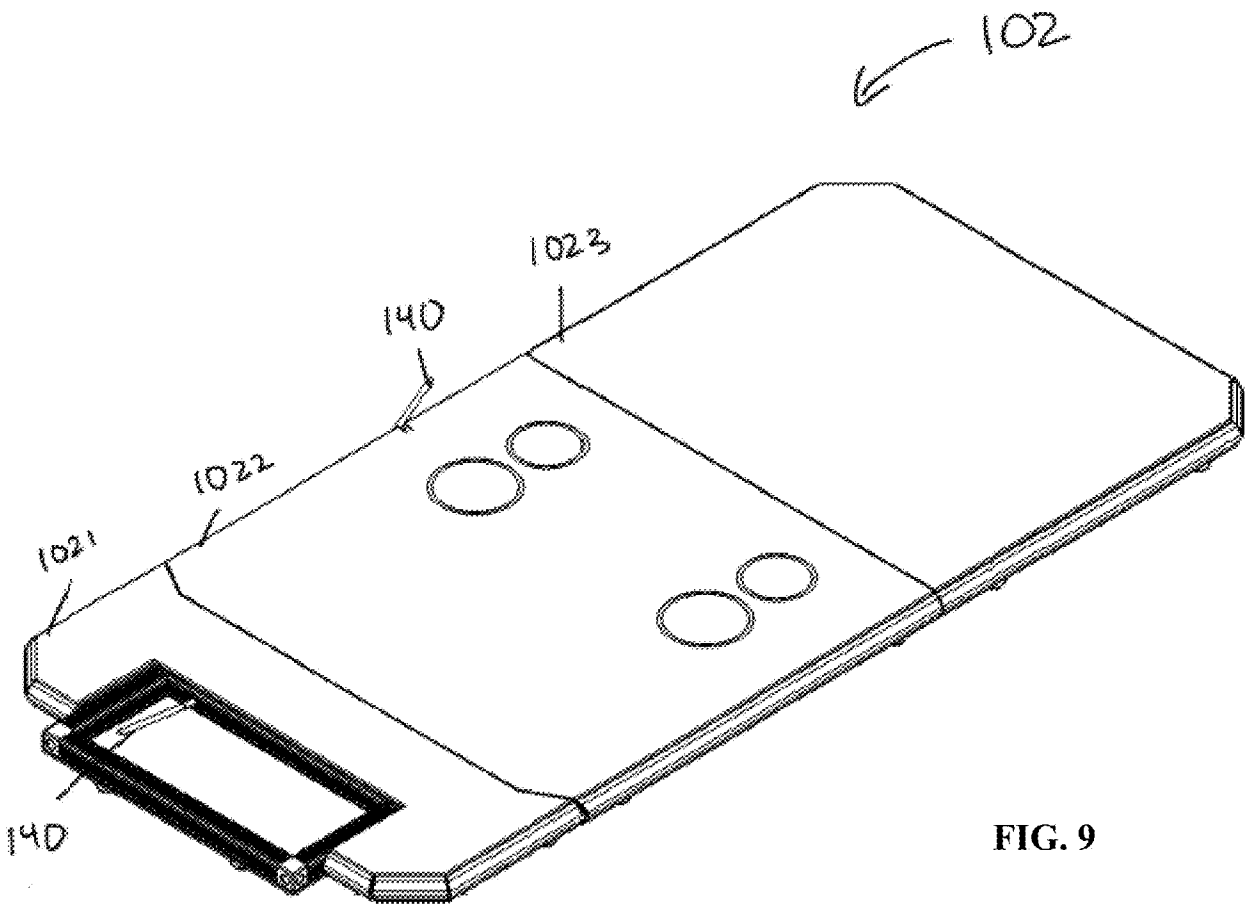
FIG. 9 is a schematic of a base of the resistance training machine according to another embodiment of the present disclosure.

Returning now to FIG. 2, in some embodiments, the machine 100 may further comprise three or more load cells 299 located inside the base 102. Each load cell 299 may be, without limitation, a single point load cell, digital load cell, beam load cell, canister load cell, and the like, and may operatively measure a force, force distribution, weight and/or weight distribution of a user working out on top of the base 102. The load cell is a transducer which converts force into a measurable electrical output. 3In the embodiment shown, the machine 100 may specifically comprise four load cells 299 spaced evenly across the four quadrants of the base 102, although other quantities and distributions are also possible. And in another embodiment shown in FIG. 9, the load cells 299 may specifically be placed in a middle section 1022 of the base 102. Appropriate markings may further be included on a surface of the base 102 to indicate the position of the load cells 299 and/or a preferred standing position for the user. The base 102 includes a water bottle pocket 165. The base 102 includes a CAN bus interface 240 and a plug in relay switch 245.

Figure 3:
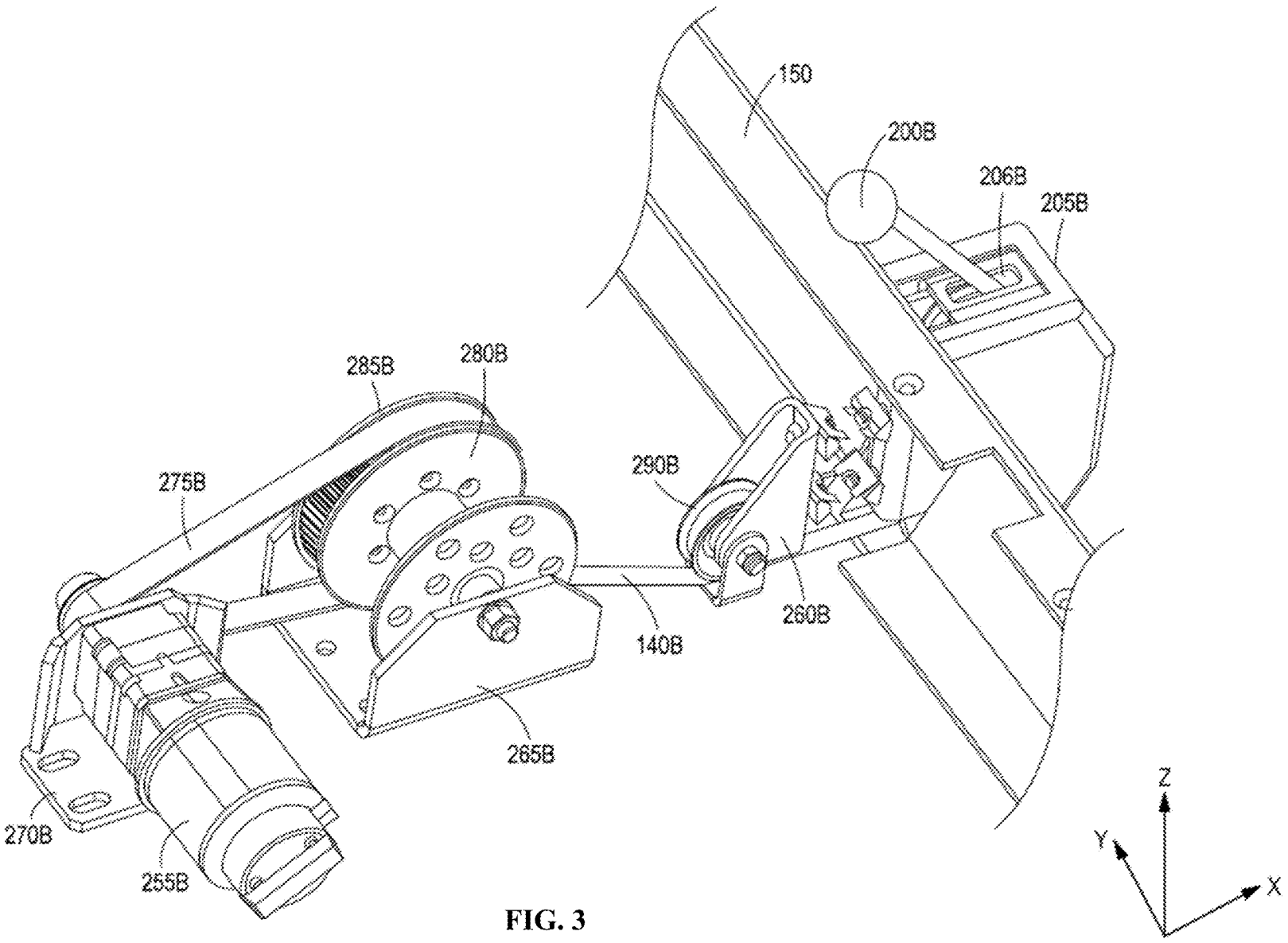
FIG. 3 is a schematic of a right motor, a right pulley system, and a right cable of the resistance training machine according to another embodiment of the present disclosure.

Turning now to FIG. 3, a detailed schematic of the right pulley system 201B is now provided. The right pulley system 201B may include a right drive belt 275B, a right drum pulley 280B, one or more right cable pulleys 290B, and a right pulley housing 205B. Given the mirrored nature of the left elements and the right elements in many embodiments, for the ease of clarity, the descriptors "left" and "right" will now be foregone. Accordingly, the following description may be applied to either or both the left and right elements of the machine 100.

With continued reference to FIG. 3, the drive belt 275 may be configured to transfer torque from the motor 255 to the drum pulley 280. According to some embodiments, the drive belt 275 may be a toothed belt, timing belt, synchronous belt, or the like, including a plurality of evenly spaced teeth (not shown) along its inner surface. In such an embodiment, complementary splines (not shown) may be included on both a shaft of the motor 255 and a wheel 285 of the drum pulley 280, and a torque ratio therein defined by specific applicational requirements. In other embodiments, the drive belt 275 may be a roller chain, and complementary sprockets (not shown) may be included on the shaft of the motor and/or the wheel 285 of the drum pulley 280. And in yet other embodiments, other mechanism for torque transfer are possible and envisioned between the motor 255 and the drum pulley 280, such as but not limited to serpentine belts, gears, clutches, etc. The drum pulley 280 is secured by a drum bracket 265*b* and to a belt wheel 285B. The motor 255B is secured by a motor bracket 270.

The cable 140 may be fixed to the drum pulley 280 at a first end and configured to wind and unwind from the drum pulley 280 as it is retracted and extended, respectively. More specifically, the cable 140 may begin at the drum pulley 280, extend through the one or more cable pulleys 290, and exit vertically through the pulley housing 205. In some embodiments, the pulley housing 205 may be located on an outer perimeter of the base 102, wherein a left pulley housing 205A and a right pulley housing 205B may be appropriately mirrored across the base 102. In other embodiments, however, the pulley housing 205 and the termination of the cable 140 may be located in other sections of the base 102, may be symmetrical across a different plane of the base 102, or may not be symmetrical at all.

Figure 13:
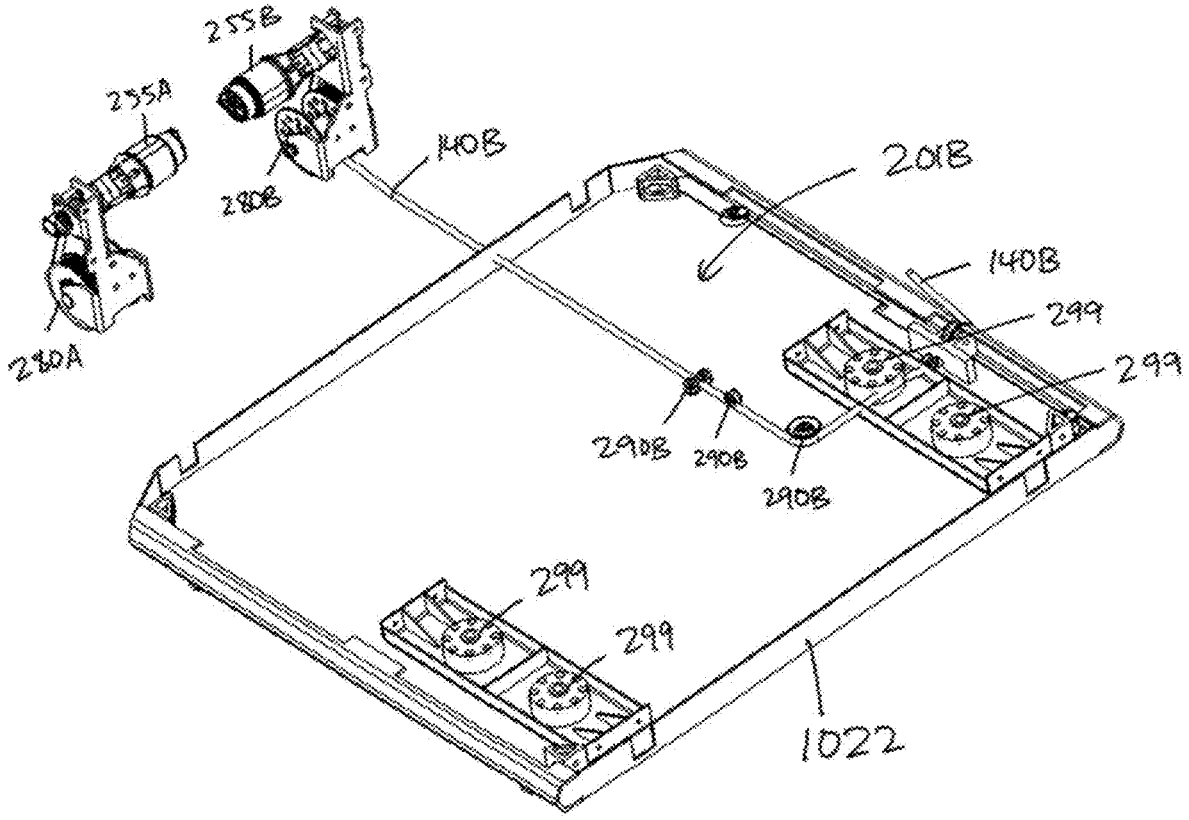
FIG. 13 is a schematic of a pulley system according to another embodiment of the present disclosure.

In an embodiment shown in FIG. 13, the motor 255 and drum pulley 280 may be located in the EM assembly 103 instead of the base 102. In such a configuration, the above disclosure may still apply, but the pulley system 201 may direct the cable 140 out of the EM assembly 103, into the adjacent base 102, through the base 102, and out of the base 102 through a pulley housing 205. No limitation is intended herein for the number of elements included in each pulley system 201, which may include elements designed to change a direction of travel for the cable 140, stabilize the cable 140, manage reactive forces, and even perform force multiplication. Finally, while only the right pulley system 201B is shown, the left pulley system 201A may be configured and behave analogously, and may or may not be symmetrical with its right counterpart.

As discussed above, the cable 140 may terminate in the knob 200, which acts as a stop defining a maximum retraction of the cable 140. For example, the pulley housing 205 may include a limiter bracket 206 having an aperture with dimensions smaller than a diameter of the knob 200. Consequently, when the cable 140 is in the docking position, the knob 200 may rest against the limiter bracket 206 of the pulley housing 205. In some embodiments, the cable 140 may terminate in a carabiner, D-ring, snap-hook, or comparable attachment device for the incorporation of various accessories, which will be discussed further below. And in the same or other embodiments, said attachment device may be in addition to or may altogether replace the knob 200.

With continued reference to FIG. 3, the motor 255 may be a 'smart' DC brushless motor, including both an integrated motor encoder and an integrated motor controller (not shown). Moreover, the motor 255 may be capable of providing independent closed-loop control of a position, speed, acceleration, torque, and current outputted by its shaft. Moreover, the machine controller 250 may be in bi-directional communication with the motor 255, and both operatively control its operation and receive feedback therefrom. Accordingly, by including an integrated encoder and controller within the motor 255 itself, the resistance training machine 100 may comprise a reduced total number of parts and a reduced total number of electrical connections, and may further improve a manufacturing efficiency, machine reliability, machine reparability, and overall cost. A motor controller is a device or group of devices that can coordinate in a predetermined manner the performance of an electric motor. A motor controller might include a manual or automatic means for starting and stopping the motor, selecting forward or reverse rotation, selecting and regulating the speed, regulating or limiting the torque, and protecting against overloads and electrical faults. Motor controllers may use electromechanical switching, or may use power electronics devices to regulate the speed and direction of a motor.

In addition to the foregoing, the motor 255 may be configured with a number of specific control features. According to an embodiment, the motor 255 may be capable of independently implementing closed-loop PID feedback; and/or may be capable of independently operating at a constant current, operating at a constant position, operating at a constant velocity, and/or implementing a specific motion profile. In the same or other embodiments, the machine controller 250 may operatively supply instructions to the motor 255 with respect to the above parameters through a CAN bus, PWM signal, or similar protocol common to the art.

For example, the machine controller 250 may command the motor 255 to operate at a specific velocity, e.g. in order to provide an isokinetic exercise to a user exercising with the machine 100. Upon receiving such a command, the motor 255 may be capable of independently maintaining the commanded velocity through internal control mechanisms without the need for additional signals from the machine controller 250 or from external encoders (not shown). The above notwithstanding, in some embodiments, the motor 255 may also receive external feedback from the machine controller 250 and/or from external encoders to supplement its internal control mechanisms.

In another embodiment, the machine controller 250 may command the motor 255 to operate at a specific current or torque, e.g. in order to provide an isotonic exercise to the exercising user. Likewise, the motor 255 may be capable of independently maintaining the necessary current or torque through internal control mechanisms without the need for external data, feedback, or commands. It may be appreciated that, with regard to isotonic exercises in particular, the machine controller 100 may be configured to convert a desired force level in the cable 140 to a current or torque level of the motor 255. In such circumstances, the machine controller 250 may be configured to consider any number of system factors, such as but not limited to force multipliers in the pulley system 201, transfer functions in the motor 255, and the like.

According to some embodiments, the motor 255 may be configured to implement a specific motion profile received from the machine controller 100, which may or may not be 'streamed' in real time. For example, the motor 255 may be configured to ramp up to or ramp down from a given velocity, e.g. during an initial or ending phase of an isokinetic exercise; or the motor 255 may be configured to ramp up to or ramp down from a given force, torque, or current, e.g. during an initial or ending phase of an isotonic exercise. In the same or other embodiments, the motor 255 may be configured to implement independent S-curve smoothing; and/or may be configured to operate at constant accelerations, operate within minimum and/or maximum velocities, operate within minimum and/or maximum accelerations, and yet other kinematic controls, which further improve a perceived smoothness and overall safety for the user.

Furthermore, in some embodiments, one or both of the left motor 255 and the right motor 255 may be capable of implementing a 'follow mode' protocol, wherein a 'follower' motor may be controlled by and execute an identical motion profile to a 'lead' motor, e.g. during symmetrical exercises.

Turning now to FIG. 5, the specifications for an exemplary motor 255 to be used in conjunction with the resistance training machine 100 are now provided. In the table shown, the motor 255 may specifically be a Falcon 500 motor. The exemplary motor 255 may have a nominal voltage between 8V and 16V, and preferably between 10V and 14V; a stall torque between 3 Nm and 6 Nm, and preferably between 4 Nm and 5 Nm; a peak power rating between 600 W and 100 W, and preferably between 750 W and 850 W; and a volume between 100 $cm^3$ and 300 $cm^3$, and preferably under 250 $cm^3$. As discussed above, each of the left motor 255A and the right motor 255B may be functionally identical and may accordingly share the above characteristics.

Figure 4:
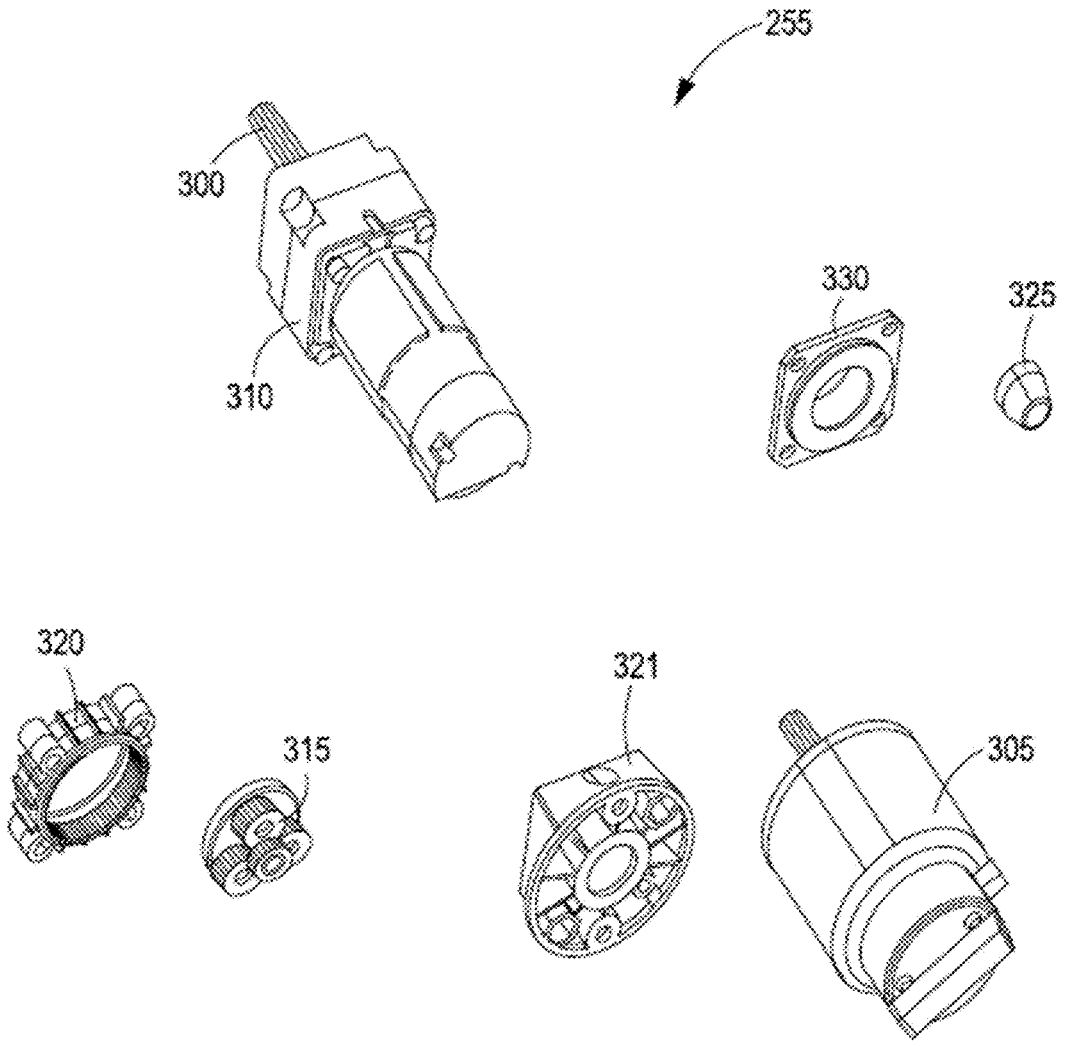
FIG. 4 is an exploded view of an exemplary motor of the resistance training machine according to another embodiment of the present disclosure.

In some embodiments, each motor 255 may further include an integrated planetary gearbox, such as but not limited to the Versa Planetary Gearbox, which may feature any number of modular and interchangeable gear stages. Without limitation, the motor 255 may further include any number of coupling components required to integrate its shaft with the pulley system 201. As shown in the exploded view in FIG. 4, an exemplary motor 255 may include a gear box housing 310, a gear box 315, a ring gear 320, a CIM adapter 321, a motor coupler 325, a bush housing 330, and yet other possible components. The gear box housing 310 includes a drive motor axle 300 and the bush housing 330 includes a motor coupler 325. Alternative gearboxes are discussed below.

Returning to FIG. 2, the machine controller 250 will now be discussed in greater detail. The machine controller 250 may be, without limitation, a microcontroller, gateway computer, field-programmable gate array (FPGA), application-specific integrated-circuit (ASIC), or comparable computing device configured to interface with at least the motors 255, the load cells 299, and the HMI 110. The machine controller 250 may receive electrical power from the power supply 235 and may comprise at least a processor, a memory in the form of a non-transitory storage medium, and a communication bus (not shown).

As previously discussed, the machine controller 250 may be in bi-directional communication with each of the motors 255. More specifically, it may command an operation of each motor 255 through a CAN bus, PWM signals, or comparable communication protocol, and may receive feedback from each motor 255 via the same or additional communication channels. For example, the machine controller 250 may command each motor 255 to operate at a specific velocity, specific torque or current level, or specific motion profile, depending on the exercise being provided for the user. In some embodiments, after supplying the initial command to the motor 255, the machine controller 250 may not be required to participate in the motor's 255 independent control processes. For example, the machine controller 250 may supply the initial command for a concentric motion of an exercise, defer to the motor's independent closed-loop control, and then, upon completion of the concentric motion, supply the command for the eccentric motion of the same exercise. And in other embodiments, the entire repetition or even the entire set of repetitions may be independently controlled by each motor 255. However, it may be appreciated that the control scheme between the machine controller 250 and each motor 255 may differ depending on the exercise being performed, wherein each exercise may be left-side only, right-side only, symmetric, functionally symmetric, etc. For example, where a symmetric exercise is provided, the machine controller 250 may provide commands to the 'lead' motor 255 only, which may be then be replicated by the 'follower' without direct input from the machine controller 250.

In addition to controlling an operation of the motors 255, the machine controller 250 may also receive feedback therefrom, including at least a position feedback and a current, torque, and/or force feedback. In an embodiment, the position feedback may be supplied by the integrated motor encoder, and the current, torque, and/or force feedback may be supplied by the integrated motor controller. In some embodiments, each motor 255 may only supply a position feedback and a current feedback, wherein the latter may be converted into the relevant parameter, e.g. force, by the machine controller 255, after accounting for force multipliers in the pulley system 201, transfer functions in the motor 255, and the like. In the same or other embodiments, additional metrics may be monitored by the machine controller 250, such as not limited to the temperature levels, voltage levels, power consumption, and efficiency of each motor 255.

Furthermore, the machine controller 250 may implement algorithms and/or software processes which perform an analysis on the data received from the motors 255 to provide user form feedback and user balance feedback on some or all exercises performed on the resistance training machine 100. Such analysis may consider, without limitation, the type of exercise being performed, the mode of the exercise (e.g. isokinetic or isotonic), the specified velocity or force levels outputted by the motors 255, the number of repetitions, the motion profile executed by the motor 255, and yet other factors; and may further depend on a sampling frequency of the motor 255 and/or the machine controller 250. For example, during an isokinetic and isometric exercise, the machine controller 250 may utilize the position feedback from the motors 255 to determine a kinematic motion of the user throughout his or her range of motion. Likewise, during an isotonic and isometric exercise, the machine controller 25 may utilize the current feedback from the motors 255 to determine a force applied by the user throughout his or her entire range of motion. In the above examples, it may be determined that the user's physical motion or force output is sufficiently balanced between the left and right sides of the body, or alternatively, that an unbalanced distribution has occurred. Such analysis by the machine controller 250 may then be communicated to the user through the HMI 110 and/or, in some circumstances, may lead to the activation of certain safety protocols. No limitation is intended herein for the type and number of user form and user balance metrics which may be derived by the machine controller 250, nor for the algorithms and mechanisms by which feedback is extracted from the motors 255 and the subsequent analysis performed.

With continued reference to FIG. 3, the machine controller 250 may also be in operative communication with the one or more load cells 299. Accordingly, the force data from each load cell 299 may be analyzed independently or in conjunction with the data from the motors 255 to further extract feedback on user form and user balance. For example, given a specific force distribution among the load cells 299, it may be determined that a user's stance is irregular, that a user's stance is unbalanced with respect to the left-side or right-side of the body, that a user's stance is fluctuating too erratically, that a user is standing unacceptably close to an edge of the base 102, etc. In any case, such feedback may be communicated to the user through the HMI 110 and/or may be used to engage safety protocols if certain tolerances are exceeded.

In the above or other embodiments, the force feedback from the load cells 299 may be consolidated with feedback from the motors 255 to provide more complex insights into user form and user balance. For example, net force data from the load cells 299 may be measured against a net force outputted by the motors 255. The comparison therein may be used to calculate a distribution of vertical (Z-axis) and horizontal (X-axis, Y-axis) force vectors, thereby arriving at a simulated pulling angle of one or both cables 140. It should be understood, however, that each of the above analyses are exemplary only, and that no limitation is intended herein for the methods or algorithms by which data from the motors 255 and the load cells 299 are measured and analyzed to drive insights for the user.

Figure 10:
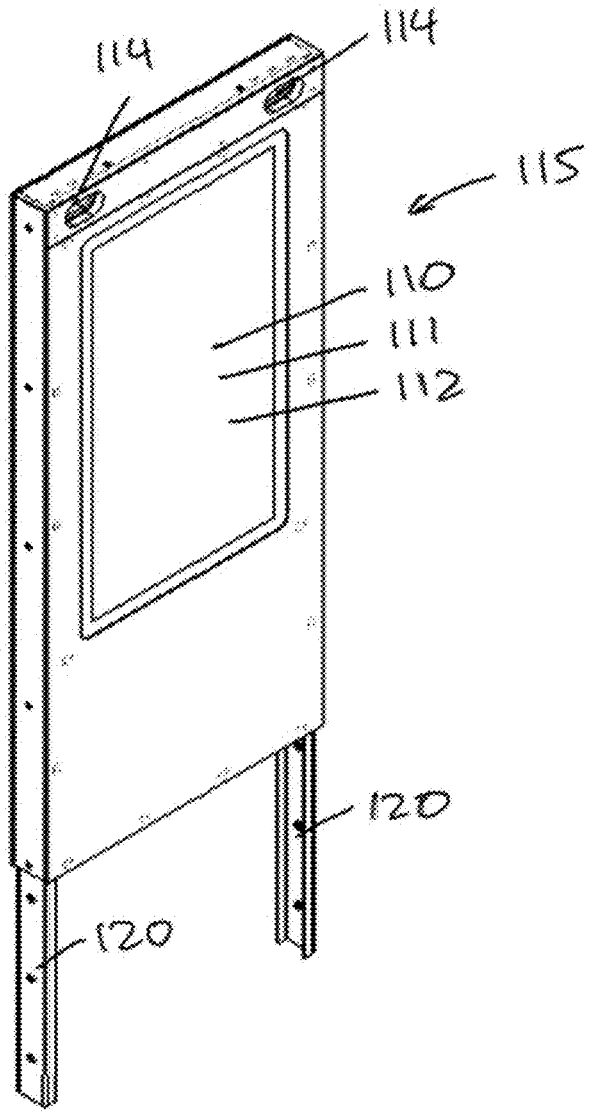
FIG. 10 is a schematic of a front upright stand of the resistance training machine according to another embodiment of the present disclosure.
Figure 11:
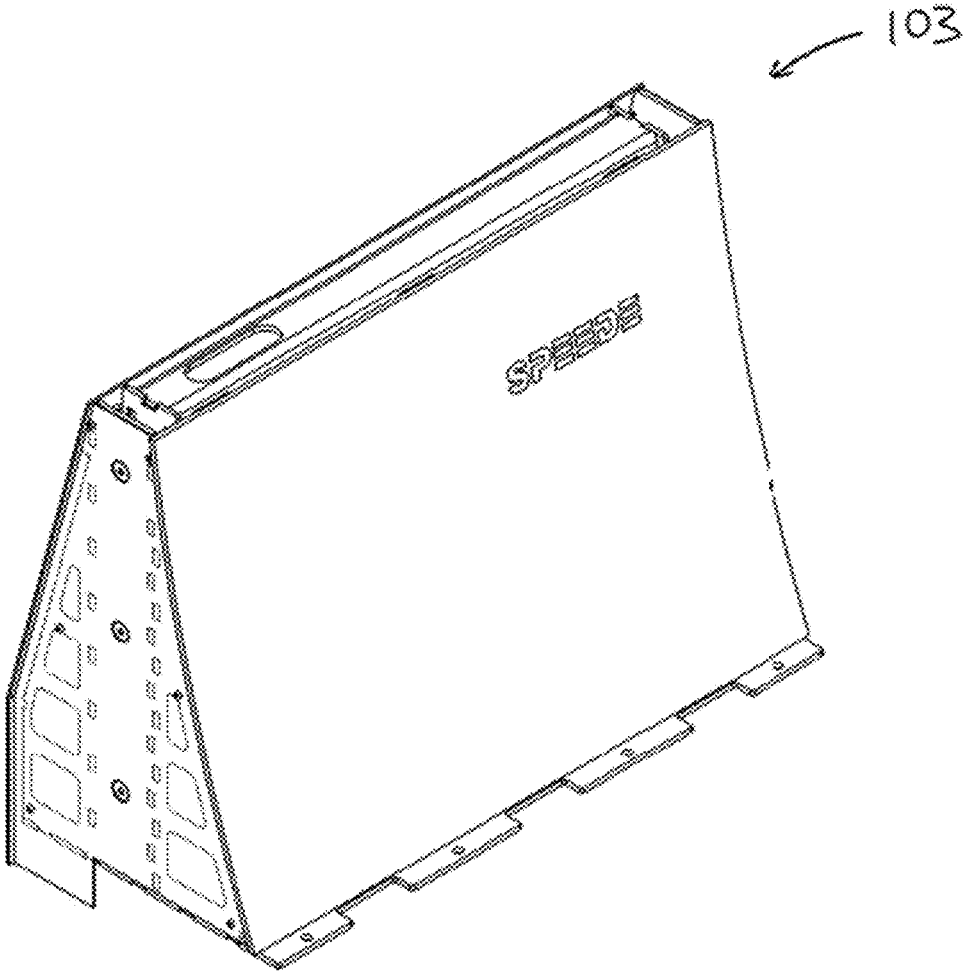
FIG. 11 is a schematic of an electromagnetic (EM) assembly of the resistance training machine according to another embodiment of the present disclosure.
Figure 12:
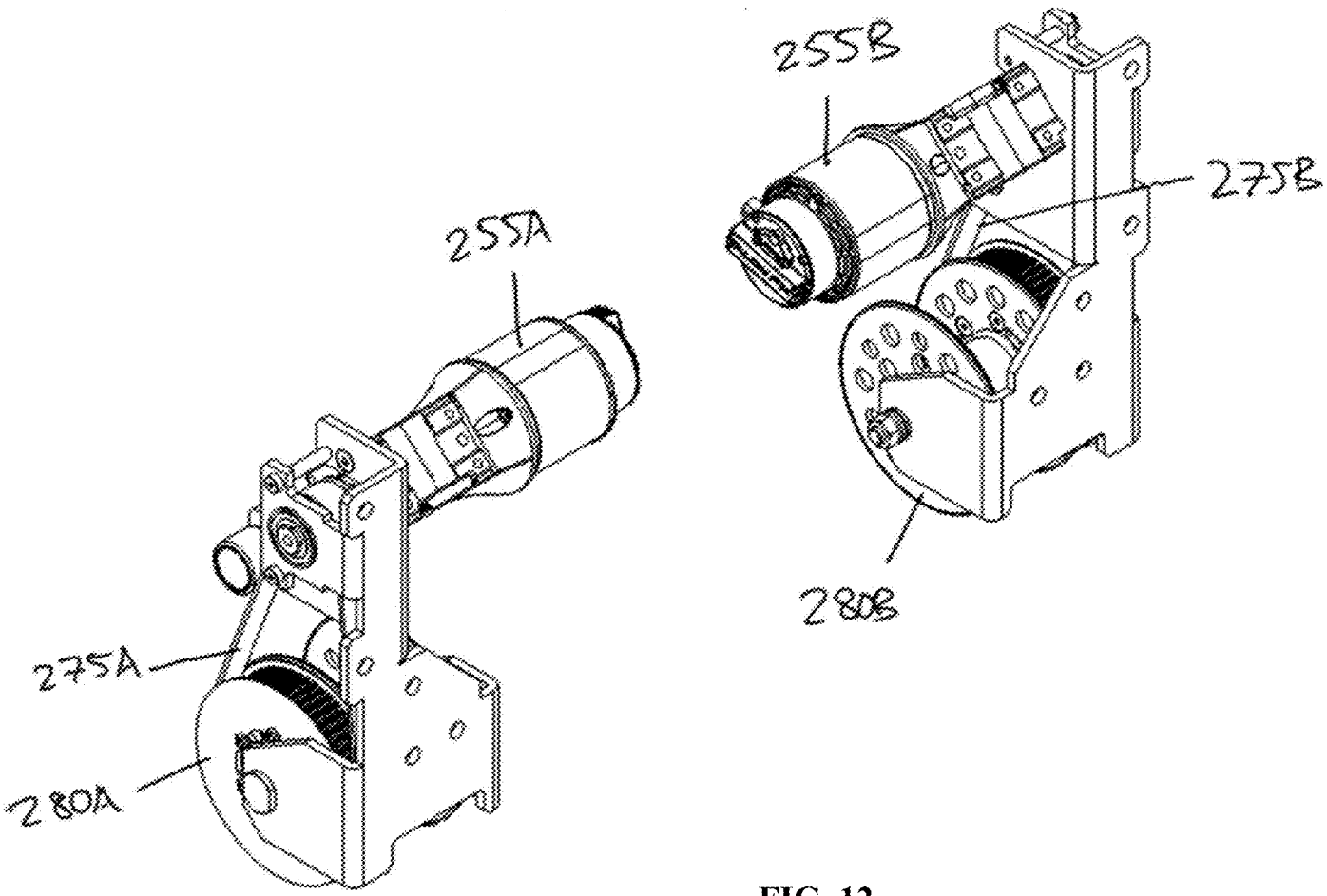
FIG. 12 is a schematic of the right motor and the left motor according to another embodiment of the present disclosure.

Returning now to FIG. 1, the HMI 110 may further include at least a display 111 and an input mechanism 112. The display 111 may include, without limitation, an electroluminescent (ELD) display, LCD monitor, LED monitor, OLED monitor, QLED monitor, touchscreen, and/or other technologies common to the art. In some embodiments, such as the one shown in FIG. 10, the HMI 110 may further include one or more speakers 114. The input mechanism 112 may be in the form of a touch screen, analog or digital buttons, analog or digital dials and knobs, computer mouse, touchpad, microphone, and/or other technologies common to the art. It may be understood that, depending on the embodiment, the machine controller 250 may include additional infrastructure necessary to interoperate with the components of the HMI 110.

In some embodiments, the machine controller 250 may further implement software to generate a graphic user interface (GUI) displayed by HMI 110. The GUI may be configured to receive a user's selection of exercise type, exercise mode, exercise velocity, exercise force, exercise repetitions etc. Furthermore, the GUI may display feedback regarding the user's form and balance, and/or the GUI may alert the user when unsafe practice are detected. For example, during an ongoing exercise, a visual representation on the HMI 10 may display a simulated user form, a relative position of the cable, a force distribution between the left and right sides of the user's body, a weight distribution across the base 102, a simulated user stance, and yet other possibilities. Indeed, no limitation is intended herein for the means by which the HMI 110 may receive selections from the user, nor for the means by which feedback on user balance and form may be displayed on the HMI 110.

Hardware

While the above has described a number of electronic components comprising the resistance training machine 100, several hardware features will now be discussed in greater detail.

More specifically, the resistance training machine 100 may comprise a number of hardware features which improve its ease of use and its customizability. In the embodiment shown in FIG. 2, the machine 100 may include at least two wheels 230 located on the base 102, enabling the machine 100 to be transported over short distances. In some embodiments, the resistance training machine 100 may be self-contained, i.e. may not require any installation with external infrastructure, and may be transportable without attachment or detachment from the floor or walls of a room. In other embodiments, however, the machine 100 may further benefit from external installation, such as through mechanisms (not shown) locking the base 102 onto the floor or mechanisms mounting the front upright stand 115 against a wall.

Returning now to FIG. 1, the resistance training machine 100 may further comprise a removable bench 135 situated on top of the base 102. In various embodiments, the bench 135 may be fully detached from the base 102, or the bench 135 may include one or more locking mechanism (not shown) securing it to the base 102. The machine 100 may further comprise any number of loose accessories, such as the triangle handle 130 and the straight bar 125, which may be attached to the left cable 140A and/or the right cable 140B. The accessories may include both dual-cable attachments and single-cable attachments, such as but not limited to curl bars, double handle bars, lat pulldown bars, V-bars, hammer ropes, chinning triangles, close-grip bars, and many others. As previously discussed, in some embodiments, each cable 140 may also terminate in a carabiner, D-ring, or similar locking device to interlock with the various attachments provided.

Figure 8:
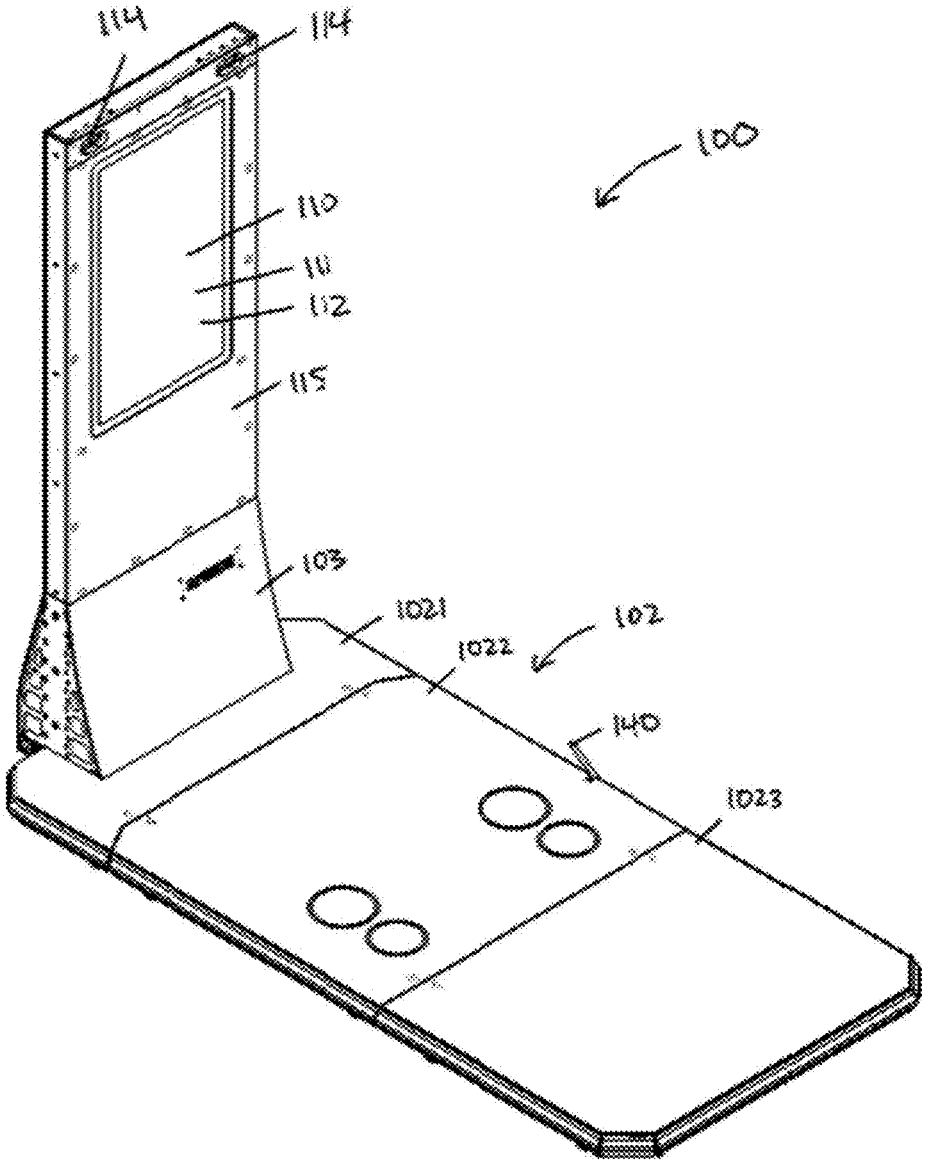
FIG. 8 is a schematic of a resistance training machine according to another embodiment of the present disclosure.

With continued reference to FIG. 1, the machine 100 may also comprise a front upright stand 115 attached to a front of the base 102 and oriented substantially vertical to the base 102 and the floor. In the embodiment shown, the HMI 110 may be located on the front upright stand 115, and its electrical connections may be wired through one or more upright supports 120. Accordingly, a user of the resistance training machine 100 may perform a workout while standing atop the base 102, holding the left and/or right cables 140, and entering selections and receiving feedback through the HMI 110. In the same or other embodiments, an accessory rack (not shown) may be attached to the front upright stand 115, and may include shelves, hooks, bar holders, trays, and other features common to the art. In another embodiment of the resistance training machine 100, as seen in FIG. 8, the HMI 110 may still be located on the front upright stand 115, which is attached to and supported by the EM assembly 103. Returning now to FIG. 1, in yet further embodiments, one or more adjustable workout pulleys (not shown) may be operatively attached to the front upright stand (115). For example, the front upright stand 115 may feature one or more vertically-oriented pulley frames (not shown), whereupon the workout pulleys may be attached to the pulley frame and slidably raised or lowered with a locking mechanism. Furthermore, each cable 140 may extend from the pulley housing 205 and run through one or more workout pulleys, which further change a direction of movement and force of the cable 140, thereby enabling yet additional exercises which can be performed on the resistance training machine 100. It may be appreciated that, regardless of the exercise being performed, all force vectors ultimately terminate in the base 102 and are transferred into the floor, a configuration which may enable larger weights to be safely handled by the machine 100. Indeed, in some embodiments, a combination of the left cable 255A and right cable 255B may be capable of exerting upwards of 800 to 1000 pounds of resistance during a workout.

Custom Workouts

Figure 6:
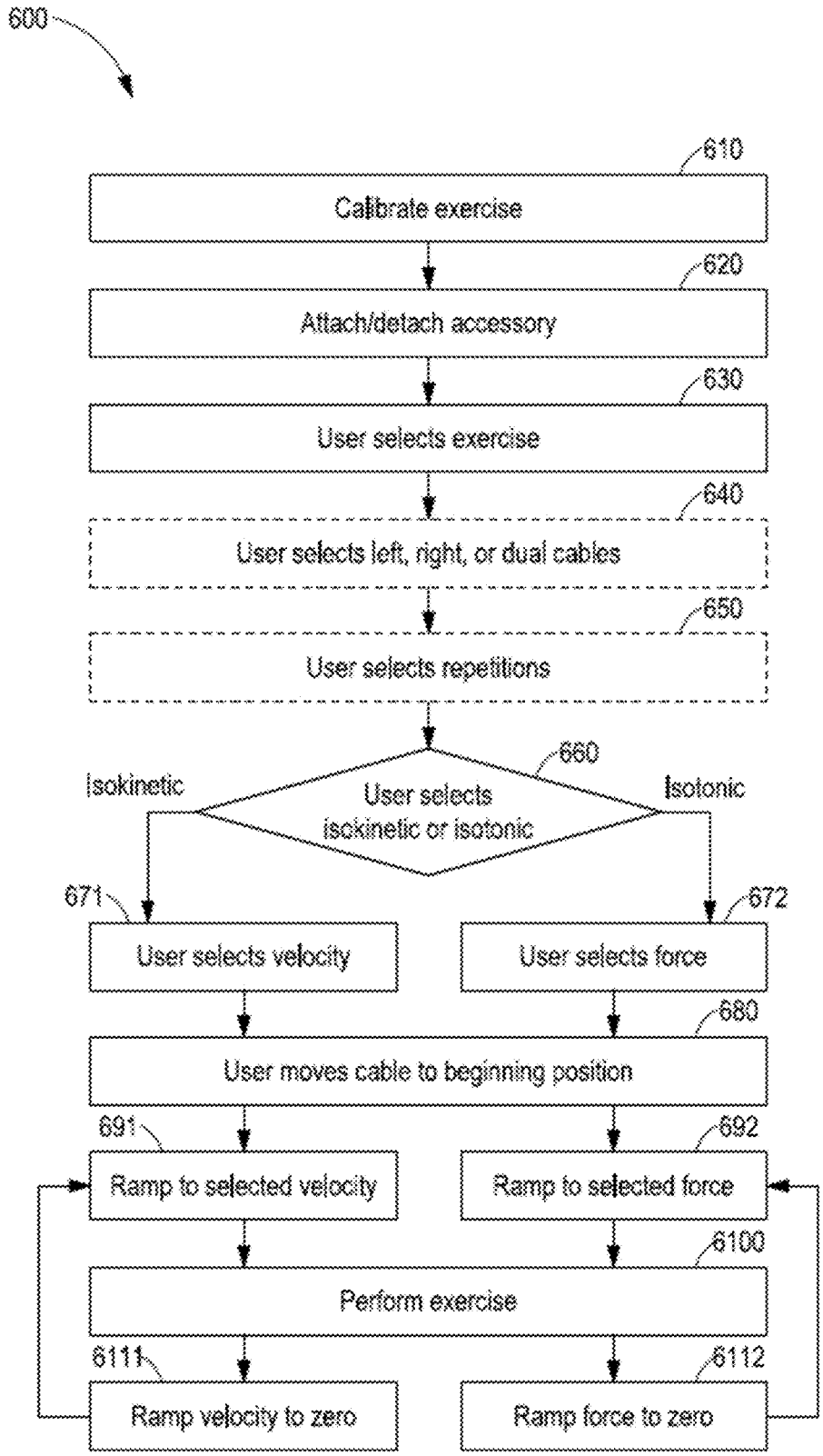
FIG. 6 is a flowchart outlining a method of providing custom workouts using the resistance machine according to another embodiment of the present disclosure.

Turning now to FIG. 6, a method of providing custom workouts using the disclosed resistance training machine is generally referred to by a reference numeral 600. The method may comprise first calibrating one or more exercises (block 610), each exercise having a relative beginning position and a relative end position. More specifically, the user may program the relative beginning position by extending or retracting one or both cables to a first position, without resistance, and holding the first position for 2-5 seconds. The user may then program the relative end position by extending or retracting one or both cables to a second position, without resistance, and holding the second position for 2-5 seconds. In some embodiments, it may be understood that the 'relative' beginning and 'relative' end positions may be used merely to define a length of travel for the cable. For example, various exercises may be started from any cable position, and the difference between the calibrated beginning and end positions may be used to determine a length of travel until the end position of the exercise. It may further be appreciated that some or all exercises may require calibration of only one of or both of the left and right cables.

In some embodiments, the machine and, more specifically, the machine controller, may be programmed to include a Calibration Mode incorporating the above steps, where said steps may be facilitated through the display and input mechanism of the HMI. In the same or other embodiments, recalibration of an exercise may be performed at any time by entering the Calibration Mode.

With continued reference to FIG. 6, in block 620, the user may optionally attach or detach an accessory to one or both cables. Next, the user may select an exercise from among the one or more calibrated exercises (block 630). In various embodiments, the user may further select to perform the exercise using the left cable only, the right cable only, or using both the left and right cables (640); the user may select a number of repetitions for the exercise (block 650); and/or the user may select an exercise mode, such as an isokinetic mode or an isotonic mode (block 660). If an isokinetic mode is selected, the user may further select a constant velocity to be outputted by the machine (block 671); or, if an isotonic mode is selected, the user may further select a constant force to be outputted by the machine (block 672).

It may be understood, however, that different exercises may require only one or both cables, or may even be performed with functional symmetry, i.e. alternating left and right cables; that different exercises may require a specific number or range of repetitions; that different exercises may be performed in a specific exercise mode only; that different exercises may require a specific number or range of velocity and force; and/or that different exercises may be preprogrammed into the machine. Indeed, no limitation is intended herein for the specific combination of exercise type, handedness, symmetry, repetitions, exercise mode, and/or range of exertions that may be provided by the machine. Furthermore, it should be understood that some or all of the above steps may be obviated, may be performed in a different order, and/or may be performed concurrently, without departing from the scope of the present disclosure. In some embodiments, the machine and, more specifically, the machine controller may be programmed to include a Ready Workout Mode incorporating the above selection steps, where said steps may be facilitated through the display and input mechanism of the HMI.

With continued reference to FIG. 6, after an exercise and its parameters are selected, the user may then begin the exercise and move the cable to a beginning position, without resistance from the motors (block 680). More specifically, the user may enter a GO command into the HMI, after which a period of time is allocated for the user to freely move the cable to the desired beginning position, such as between 1 and 10 seconds and, more preferably, between 4 and 6 seconds. As previously discussed, this beginning position may then be used by the machine controller to define the end position of the exercise, based on the difference between the relative beginning and the relative end that was calibrated for the exercise.

Next, the motor may ramp up the cable to a constant velocity (block 691), e.g. for an isokinetic exercise, or ramp up the cable to a constant force (block 692), e.g. for an isotonic exercise. The user may then perform a repetition of the exercise (6100) at the constant velocity or force. Near the end position of the motion, the motor may ramp down the cable from the constant velocity to zero or a minimum velocity (block 6111), e.g. for the isokinetic exercise; or ramp down the cable from the constant force to zero or a minimum force (block 6112), e.g. for an isotonic exercise. Finally, blocks 691-6111 may be repeated for a selected number of repetitions, and the workout completed. In various embodiments, specific ramp up and ramp down times may be selected by the user, set by the manufacturer, and/or changed according to the associated exercise; and may be set to between 0.5 and 3 seconds, and more preferably, between 1 and 2 seconds. Furthermore, additional smoothing, such as S-curve smoothing, may be applied to the motion profile of the cable during either ramp up or ramp down procedures.

In some embodiments, the machine may feature a Pull-in Slack mode that is designed to retract the cables when no longer in use. Accordingly, the method 600 may include the motor retracting the cable to the docking position at a minimum force or minimum velocity if/when certain conditions are met. According to an embodiment, the Pull-In Slack mode may be activated if/when the cable is not in the docking position and no resistance has been detected by the machine controller for between 5 and 15 seconds and, more preferably, between 8 and 12 seconds. In the same or other embodiments, the Pull-in Slack Mode may be deactivated (and the retraction ceased) if, during retraction, a resistance is detected in the cables. It may be understood that Pull-in Slack mode may also be activated in other circumstances, and may be activated for a single cable at a time or both cables concurrently.

In some embodiments, the machine may further feature any number of safety protocols designed to protect the user and/or the machine when dangerous activity is detected or when certain limits are exceeded. In such embodiments, the machine may enter a Non-workout Mode, wherein no resistance is exerted by one or both motors. In the same or other embodiments, the Non-workout Mode may be followed by the Pull-in Slack Mode in order to reset the machine. For example, the machine may enter the Non-workout Mode if, in the course of an exercise: a force exceeding between 300 and 700 pounds or, more preferably, 500 pounds is exerted on either motor; a repetition exceeds between 6 and 14 seconds or, more preferably, 10 seconds; or either or both knobs are within between 0.5 and 2 inches or, more preferably 1 inch of the docking position. In such circumstances, the motor may cease providing resistance, followed by a brief pause, and then begin retraction through the Pull-in Slack mode. As discussed above, the machine may further utilize the load cells to enable additional safety protocols, in combination with or independent of the above conditions. For example, the Non-workout Mode may be activated if the cable is not in the docking position and one or more load cells detect an unsafe user balance, or if the user is standing to close to an edge of the base.

Furthermore, in some or all of the above embodiments, a corresponding status or alert may be communicated to the user through the HMI, informing the user of the type, cause, and/or remedy to an encountered problem. It should be understood that the above conditions and protocols are exemplary only, that other conditions or sets of conditions may be programmed to activate the Non-workout Mode, that periods of time other than the above may be necessary or sufficient to activate the Non-workout Mode, and that other procedures may be activated by the machine as part of various safety protocols without departing from the scope of the present disclosure.

Figure 7:
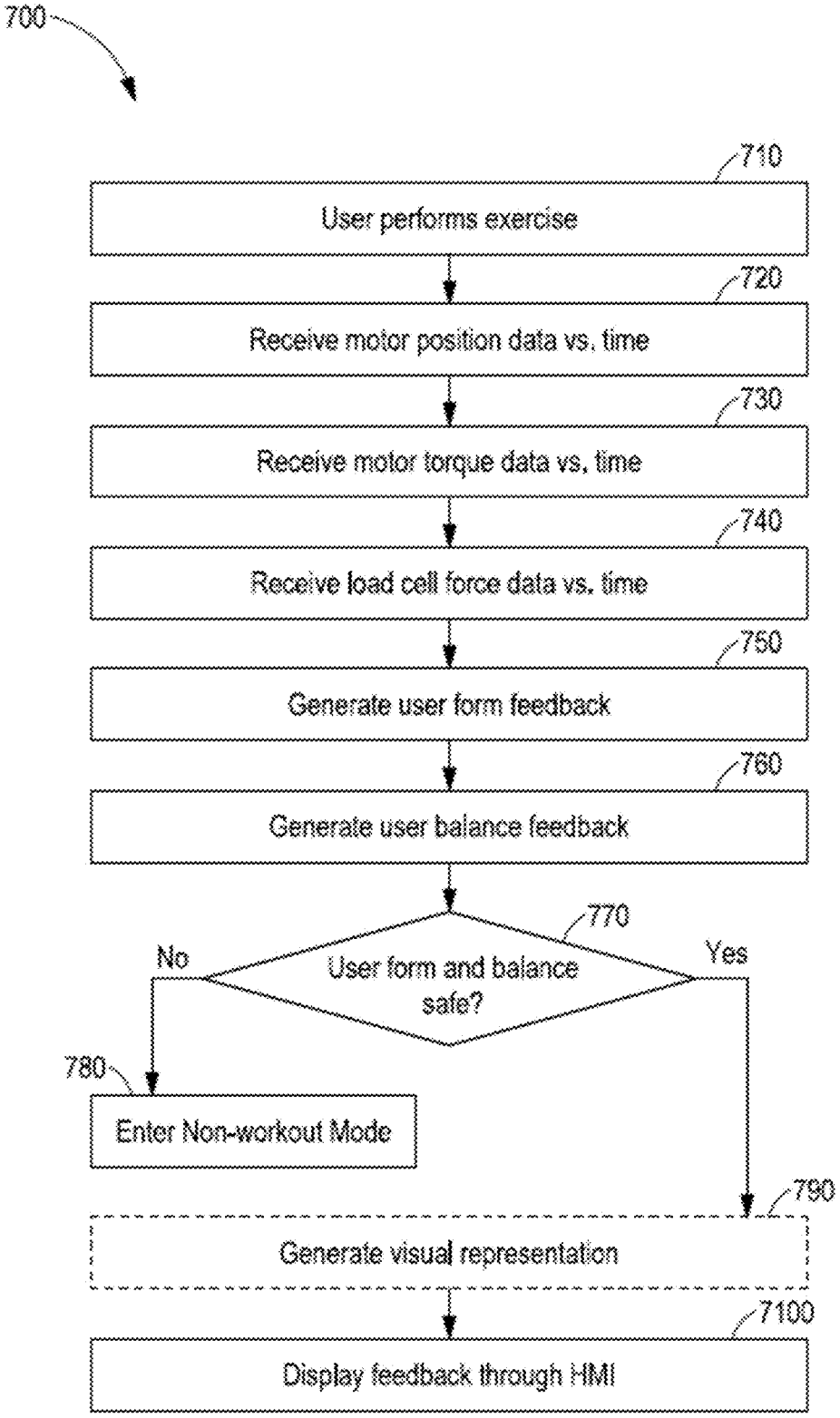
FIG. 7 is a flowchart outlining a method of providing feedback on user form and user balance during an exercise on the resistance training machine according to another embodiment of the present disclosure.

Turning now to FIG. 7, a method of providing feedback on user form and user balance while exercising on the resistance training machine is generally referred to by a reference numeral 700. As seen in FIG. 7, the method may first comprise a user performing an isokinetic exercise or an isotonic exercise using resistances supplied by the motors of the machine (block 710). During the exercise, the machine controller may receive position data as a function of time from the motor (block 720), and the machine controller may receive current, torque, and/or force data as a function of time from the motor (block 730). In an embodiment, the machine controller may further receive force data, weight data, force distribution data and/or weight distribution from the load cells (block 740).

Next, in block 750, the machine may generate feedback pertaining to the user's form from some or all of the above data received by the motors and the load cells; and, in block 760, the machine may generate feedback pertaining to the user's balance from some or all of the above. As previously discussed, no limitation is intended herein for the algorithms or strategies by which insights may be extracted from the underlying data. Finally, the machine may display the user form and user balance feedback through the HMI through any number of means known in the art, such as but not limited to a GUI, graphs, charts, tables, simulations, audio cues, and the like (block 7100). In some embodiments, the machine controller may specifically generate a visual representation of the user's form and balance (block 790), such as but not limited to a 3D model, a color-coded display of active muscle groups, a distribution of left-side and right-side forces, and many other possibilities, which may improve a comprehension and/or enjoyment for the user.

In some embodiments, the above feedback information may also be used to activate safety protocols. As seen in block 780, if unsafe user activity is detected, the machine may enter a Non-workout Mode, wherein the motors may cease to apply resistance. In the same or other embodiments, appropriate alerts, such as visual or audio cues, may further be communicated to the user through the HMI 10. However, it should be understood that other safety triggers and other resulting actions are also possible and envisioned.

TABLE 1 modes and max force and velocity

| Mode | Description | MAX Force at Handle | MAX Velocity at Handle |
|---|---|---|---|
| Isotonic Mode (Constant Force Mode) | When the handles move at a constant force regardless of how fast/slow the user moves the handles during their workout | 500 lbs/handle | 3 ft/ 0.5 seconds |
| Isokinetic Mode (Constant Velocity Mode) | When the handles move at a constant velocity regardless of how much force (hard/light) the user puts on the handles during their workout | 1000 lbs/handle | 10 inch/ 1.0 seconds |
| Calibration mode (Pull in/out slack) | How the handles function when the user is not in a workout. It should feel like a seat belt in a car: under constant light tension | 20 lbs/handle | 3 ft/ 0.5 seconds |

Geared System

Figure 14:
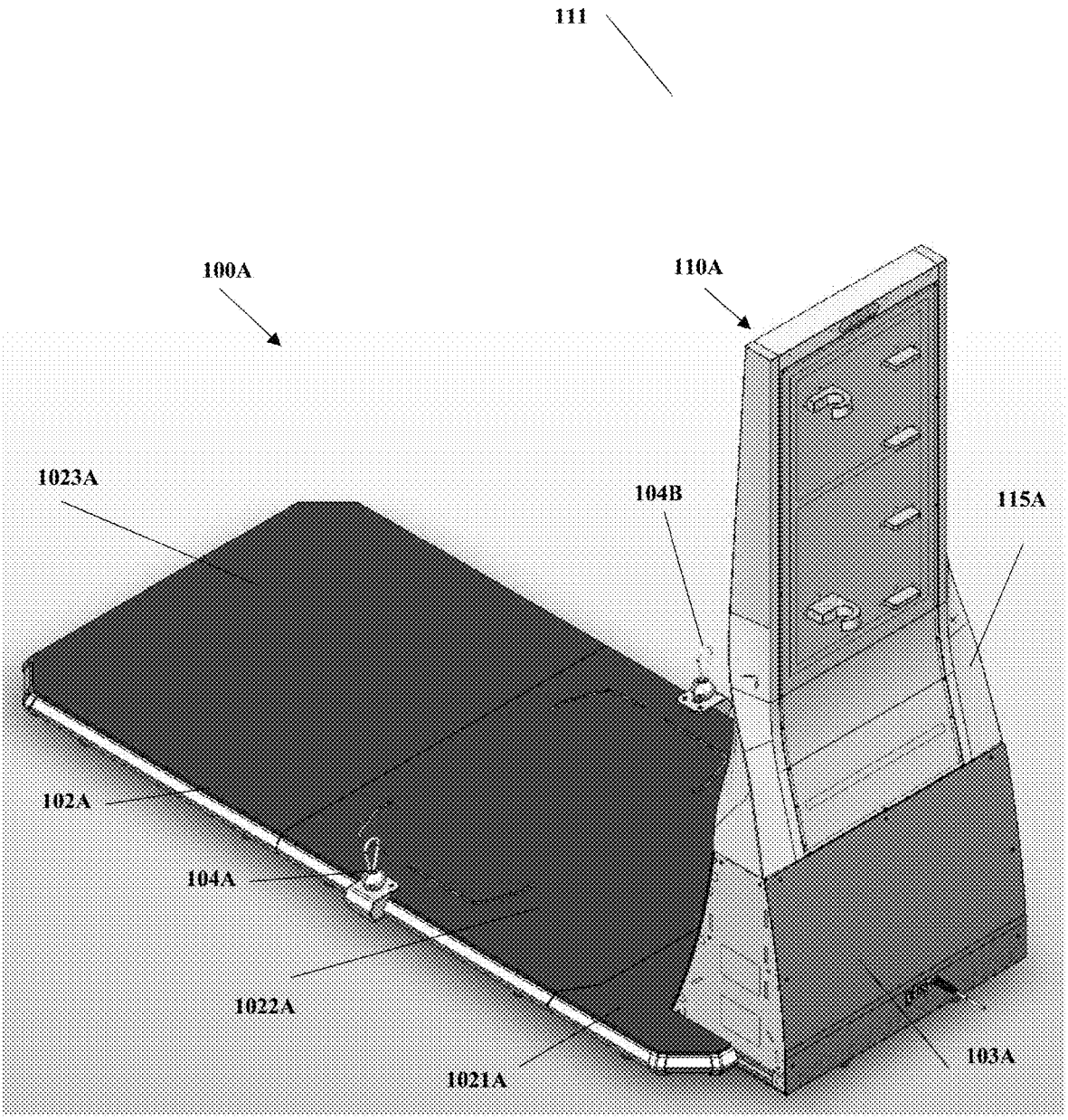
FIG. 14 is a perspective view of the geared-motor resistance training machine, according to one embodiment.

Referring now to the drawings and with specific reference to FIG. 14, a diagram of a geared-motor resistance training machine is generally referred to by a reference numeral 100A and may be generally referred to as geared machine or geared resistance training machine. The geared-motor resistance training machine 100A may be situated in a home, apartment, hotel, commercial gym, and the like, and may be capable of enabling both isotonic exercises or isokinetic exercises at constant force or constant velocity levels, respectively, for a user. Furthermore, the resistance training machine may measure and communicate form feedback, force feedback, velocity feedback, position feedback, calibration feedback, and balance feedback during some or all exercises performed on the geared machine 100A, thereby improving workout efficacy and safety for the user. As seen in FIG. 14, the geared motor machine 100A may comprise at least a platform 102A, a left cable 140A, a right cable 140B, and a human-machine interface (HMI) 110A to select one or more exercise modes. The geared resistance training machine 100A may comprise the platform 102A for a user to stand on and engage in exercises, wherein the platform may include a front section 1021A, a middle section 1022A, and a rear section 1023A. An electromagnetic assembly (EM) 103A may be attached to the front section 1021A, and a front upright stand 115A may be attached to and extend vertically from the EM assembly 103A to display the HMI 110A, alternatively, the EM assembly 103A may be attached to any portion of the platform 102A. The EM assembly 103A operates with geared motors to provide resistance training for isotonic exercises and isokinetic exercises in a plurality of modes. The-geared motors work together to provide left and right movements on the resistance training machine, where the geared motors work in parallel with a speed gear box to employ a low force and a high-speed work out and a slower speed but a high force work out.

Figure 15:
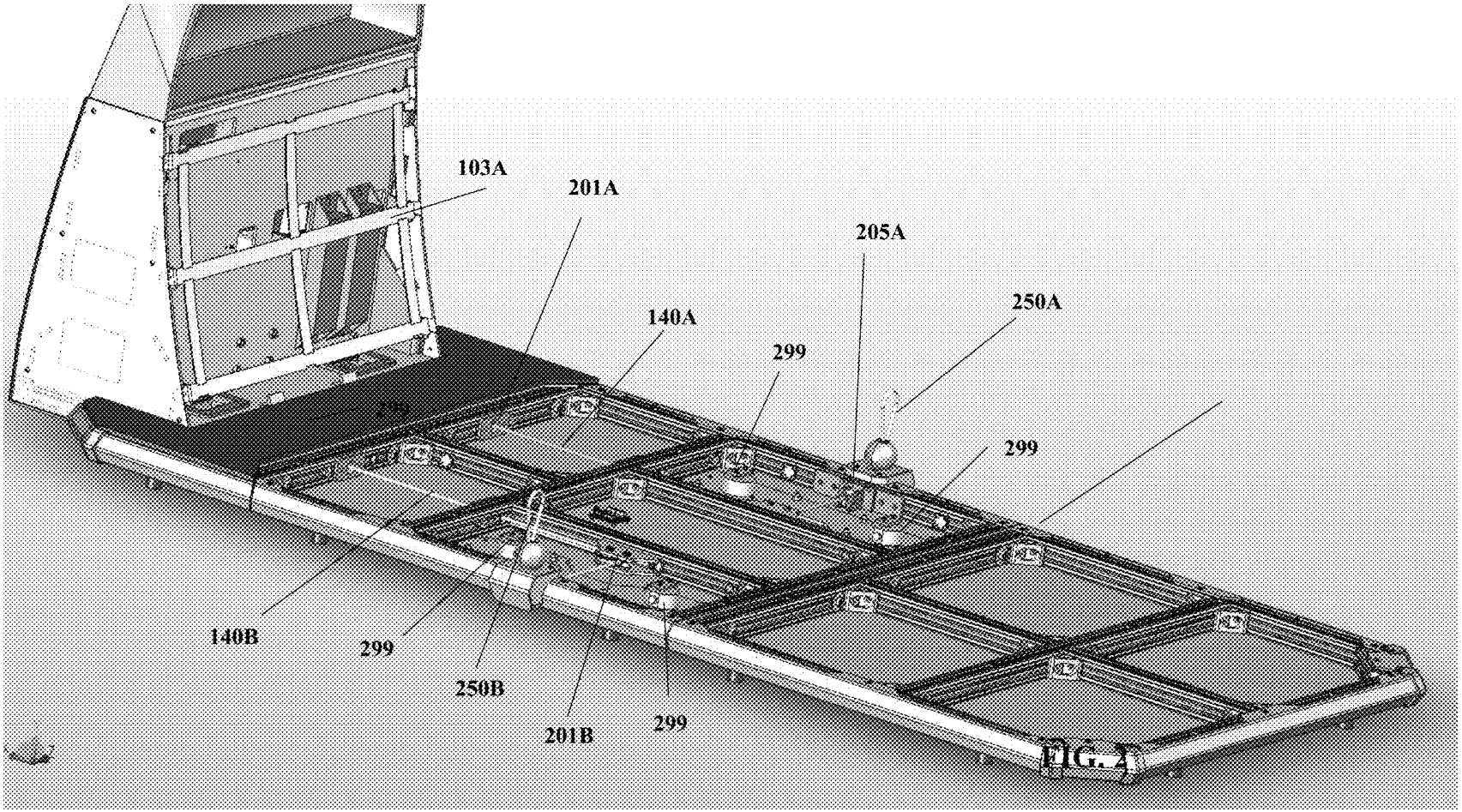
FIG. 15 is a cut-away perspective view of the platform and EM assembly of the geared-motor resistance training machine, according to one embodiment.

Turning now to FIG. 15, a cut-away schematic of the platform 102A of the geared resistance training machine 100A is provided. In particular, the geared resistance training machine 100A may comprise a left pulley system 201A, a right pulley system 201B, a left cable 140A, a right cable 140B, a right clip 250B, a left clip 250A, and one or more load cells 299 located in the platform 102A. The right clip 250B and the left clip 250A are operably coupled with the ends of the right cable 140B and the left cable 140A to connect to a plurality of handles for exercising. The left cable 140B and the right cable 140A are operably connected to the platform 102A by the left pulley system 201A and the right pulley system 201B to permit fluid movement of the cables from the EM assembly 103A. The EM assembly 103A houses the geared system and the motor system, as described below.

Figure 16:
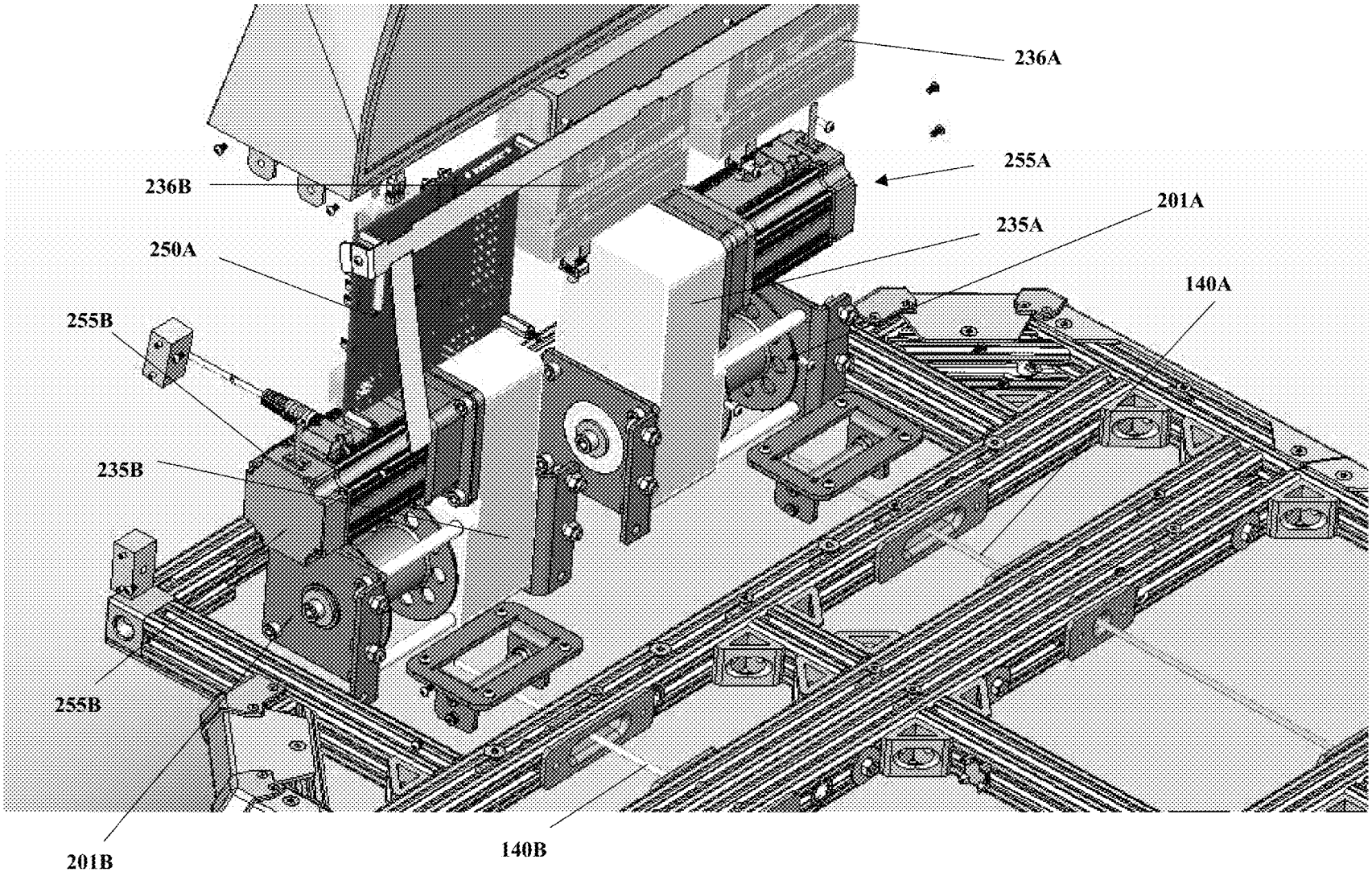
FIG. 16 is a cut-away enlarged view of the left and right motor system, according to one embodiment.

As shown in FIG. 16, the geared resistance training machines may comprise a left geared system 235A, a right geared system 235B, a left motor assembly 255A, a right motor assembly 255B, a left pulley system 201A, a right pulley system 201B, a left cable 140A, a right cable 140B, a machine controller 250A, a left motor encoder 236A, a right motor encoder 236B. Given the mirrored nature of the left elements and the right elements in many embodiments, for the ease of clarity, the descriptors "left" and "right" may be foregone if not specially indicated by a designator "A" after the reference numeral for "left" and designator "B" after the reference numeral for "right". Accordingly, the following description may be applied to either or both the left and right elements of the geared resistance training machine 100A. While each of the above components are located within the EM assembly 103A in FIG. 16, in other embodiments, some or all of the above components may be placed elsewhere in the machine 100A. For example, each of the geared system 235, motors 255, and machine controller 250 may be located in the platform 102A, and the pulley systems 201 may be located in both the EM assembly 103A and the platform 102A. No limitation is intended herein for the precise placement of the components of the machine 100, which may include any combination of locations in the platform 102A, EM assembly 103A, and front upright stand 115A.

The power supply may receive electrical power from an external supply and may provide electrical power to some or all of the other electronic components of the machine 100, where wattage ratings may be determined by specific application requirements. In some embodiments, such as the one shown in FIG. 16, each of the aforementioned motors, pulley systems, and cables may be substantially mirrored across a central plane (defined by the Y-axis and Z-axis) of the machine 100. In other embodiments, however, the left elements and the right elements may necessarily be symmetrical, and may be offset with respect to the X-axis, Y-axis, or Z-axis, depending on specific application requirements. Regardless, for ease of clarity, the following discussion with respect to the right elements of the machine 100 may be analogously applied to their left counterparts, and vice versa.

Figure 17:
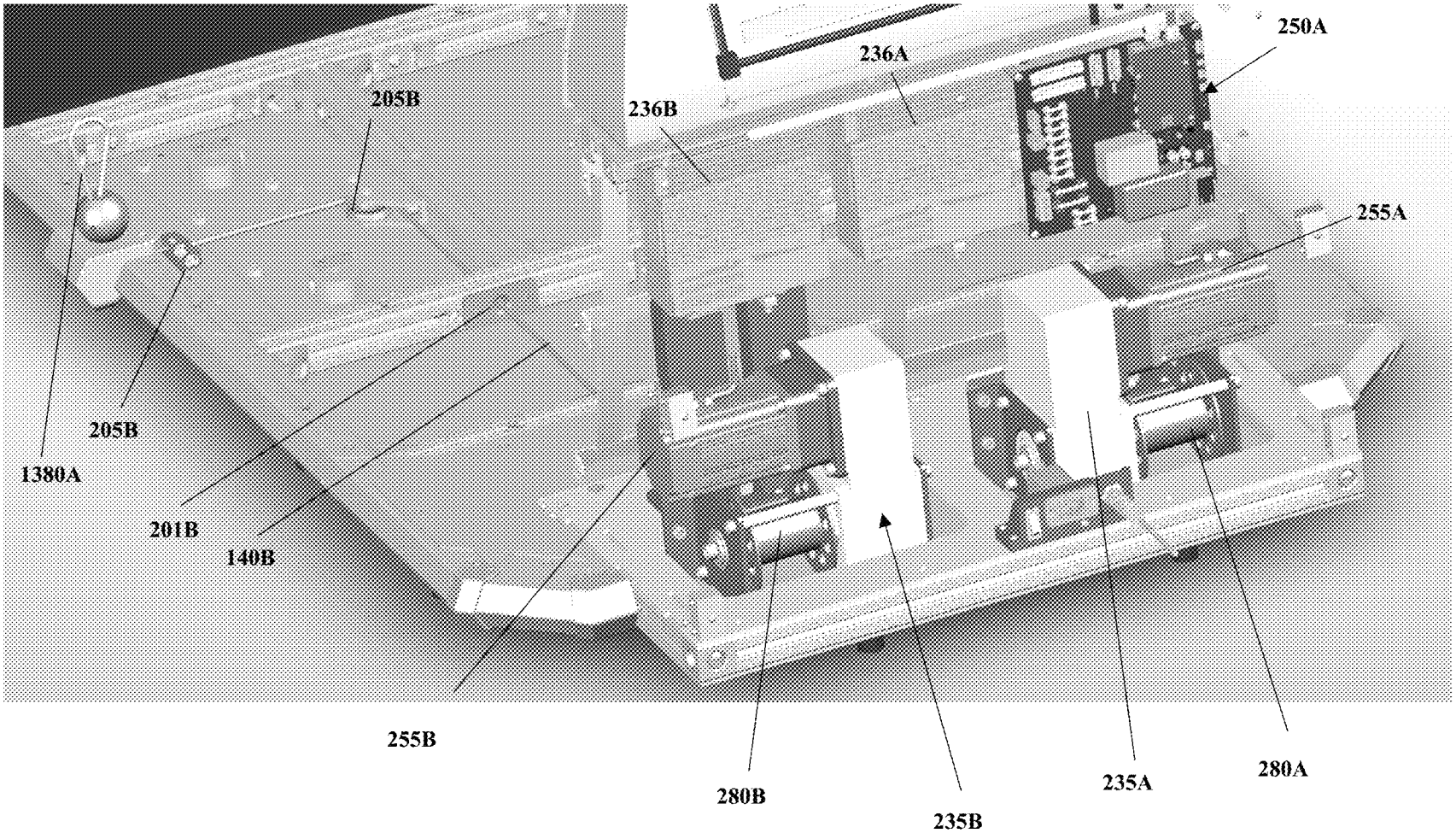
FIG. 17 is a schematic of cut away back view of the left and right motor system for the geared-motor resistance training machine, according to one embodiment.

As seen in FIG. 17, the right pulley system 201B may be configured to operatively convert a torque outputted by the right motor system 255B to a vertical (Z-axis) force vector, i.e. a force vector having a non-zero vertical (Z-axis) component. Associated with the right pulley system 201B is the right cable 140B, which may be operatively, but not necessarily directly, coupled to the right motor 255B at a first end, and which may run through the right pulley system 201B. In other words, a torque generated by the right motor 255B may be operatively converted into tension in the right cable 140B through the right pulley system 201B at the second end of the right cable 140B. The torque generated by the right motor 255B may be increased or decreased depending on the gear selected from the right gear system 235B. The gear selection from the right gear system 235B is controlled by the motor encoder 236B and the machine controller 255A. As previously discussed, an analogous configuration may be applied to the left motor system 255A, left pulley system 201A, left gear system 235A, left motor encoder 236A, and left cable 140A. The cables 140A, 140B may be fixed to the drum pulley 280A, 280B at a first end and configured to wind and unwind from the drum pulleys 280A, 280B as it is retracted and extended, respectively. More specifically, the cables 140A, 140B may begin at the drum pulleys 280A, 280B, extend through the one or more cable pulleys, and exit vertically through the pulley housings 205A, 205B. The cables 140A, 140B exert a force countered by the left motor 255A and right motor 255B, respectively. In some embodiments, the pulley housing 205 may be located on an outer perimeter of the platform 102A, wherein a left pulley housing 205A and a right pulley housing 205B may be appropriately mirrored across the platform 102A. In other embodiments, however, the pulley housing 205 and the termination of the cable 140 may be located in other sections of the platform 102A, may be symmetrical across a different plane of the platform 102, or may not be symmetrical at all. No limitation is intended herein for the number of elements included in each pulley system 201, which may include elements designed to change a direction of travel for the cable 140, stabilize the cable 140, manage reactive forces, and even perform force multiplication. In one embodiment, the right pulley housing 205B and the left pulley housing 205A includes a sensor to measure the tension on the right and left cable, respectively. The pulley housing sensor measures tension to send feedback to the motors if the motors stop or slow down below a threshold and prevent the cables from being tangled or wrapped around any part of the pulley systems. Finally, the right pulley system 201B and the left pulley system 201A may be configured and behave analogously, and may or may not be symmetrical with its right counterpart.

Returning now to FIG. 15, in some embodiments, the machine 100A may further comprise a plurality of load cells 299 located inside the platform 102A. Each load cell 299 may be, without limitation, a single point load cell, digital load cell, beam load cell, canister load cell, pressure sensor, force sensor, force plates, transducers, and the like, and may operatively measure a force, force distribution, weight and/or weight distribution of a user working out on top of the platform 102. In the embodiment shown, the machine 100 may specifically comprise at least load cells 299 spaced evenly across the middle section 1022 of the platform 102, although other quantities and distributions are also possible in the front section 1021 and the back section 1023. As shown in FIG. 15, the load cells 299 may specifically be placed in the middle section 1022, the front section 1021, and the back section 1023 of the platform 102. Appropriate markings may further be included on a surface of the platform 102 to indicate the position of the load cells 299 and/or a preferred standing position for the user.

As shown in FIG. 16, the right pulley system 201B and the left pulley system 201A is operably coupled to a right motor system 255B and a left motor system 255A, respectively. The right motor system 255B is operably coupled to the right drum pulley 280B, one or more right cable pulleys 290B, and a right gear system 1280B.

The right gear system may be operably coupled a right linear actuator, which switches the right gear system to from smaller gear to a higher gear in the isokinetic mode and switches the from a smaller gear to a lower gear in the isotonic mode or calibration mode. The higher gear forces the right motor system achieve a higher force and slower speed on the right cable, while the lower gear forces the right motor system achieve a lower resistive force on the cable allowing for a higher speed of the right cable.

In one embodiment, the constant force mode or isotonic mode is when the handle moves at a constant force regardless of how fast or slow the user moves the handles during their workout. The max force at the handle is about 500 lbs/handle and the max velocity at the handle is about 3 ft/0.5 seconds. In another embodiment, the constant velocity mode or the isokinetic mode is when the handle moves at a constant velocity regardless of how much force the user puts on the handles during the workout. The max force in the isokinetic mode is about 1000 lbs/handle and the max velocity at the handle is about 10 inch/1.0 seconds. The pull in/slack mode is for calibration and is how the handle function when the user is not in a workout and the tension on the handle is under constant light tension. The calibration mode has a max force of about 20 lbs/handle and a max velocity of about 3 ft/0.5 seconds.

In one embodiment, the gear ratio of the lower gear to the higher gear is 1:16, 1:15, 1:14, 1:13, 1:12, 1:11, 1:10, 1:9, 1:8, 1:7, 1:6, 1:5, 1:4, 1;3, 1:2, or 1:1. The right motor system 255B may feature any number of modular and interchangeable gear stages when adding additional motors to the right motor system and the left motor system, such as one gear, two gears, three gears, and the like. Without limitation, the motor systems 255 may further include any number of coupling components required to integrate additional motors and their shaft to the gears with the pulley system 201. The first right motor 1360B and the second right motor 1370B achieve a resistive force of at least about 100 lbs to about 500 lbs. The right motor system 255B and a left motor system 255A work in parallel and are controlled by the machine controller 250.

Figure 18:
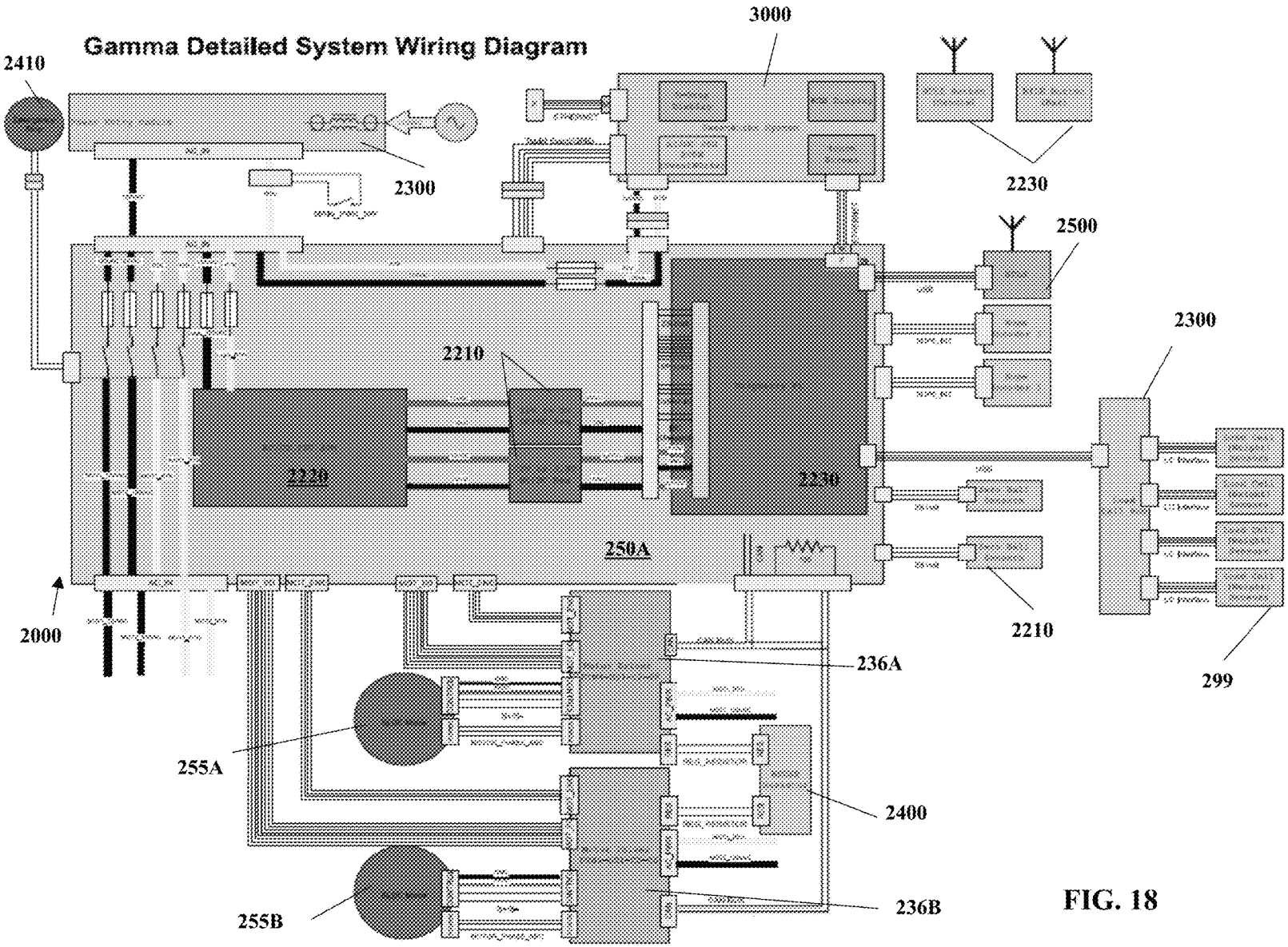
FIG. 18 is a schematic of the hardware architecture for the geared-motor resistance training machine, according to one embodiment.

As shown in FIG. 18, the right motor system 255B, the left motor system 235A operate under the control of the machine controller 250A comprising a first control system 2000 in operably communication with the left motor encoder 236A and the right motor encoder 236B. The left motor encoder 236A and the right motor encoder 236B are operable with a regen resister 2400. The first control system 2000 operably communicates an HMI board 3000, a load cell hub 2300, a left encoder 236A, a right encoder 236B, a Bluetooth module 2500, and a power entry module 2300. The first control system 2000 operably communicates with zero ball sensors 2210 an antenna 2230, the HMI board or the user display operating system 3000, and the power distribution board power entry module 2300. The user display operating system 3000 operates the display, touch screen, and User Interface (UI). The first control system 2000 operably communicates with 2300 load cell hub, which controls and receives input from the load cells 299 in the platform. The right motor encoder 236B programs the operating modes of the right motor 255B, and the left motor encoder 236A programs the operating modes of the left motor 255A. The wireless button 2230 may signal start/stop functions to the control system 2000 and the wireless button 2500 may operably coupled to the rope, a handle or bar connected to the left and right cable. The first control system 2000 and the user display operating system 3000 operate under a system software architecture to control and calibrate the resistance training machine. An emergency stop button 2410 may provide the user with an emergency stop feature to stop the motors from pulling on the cable or handle.

Figure 20:
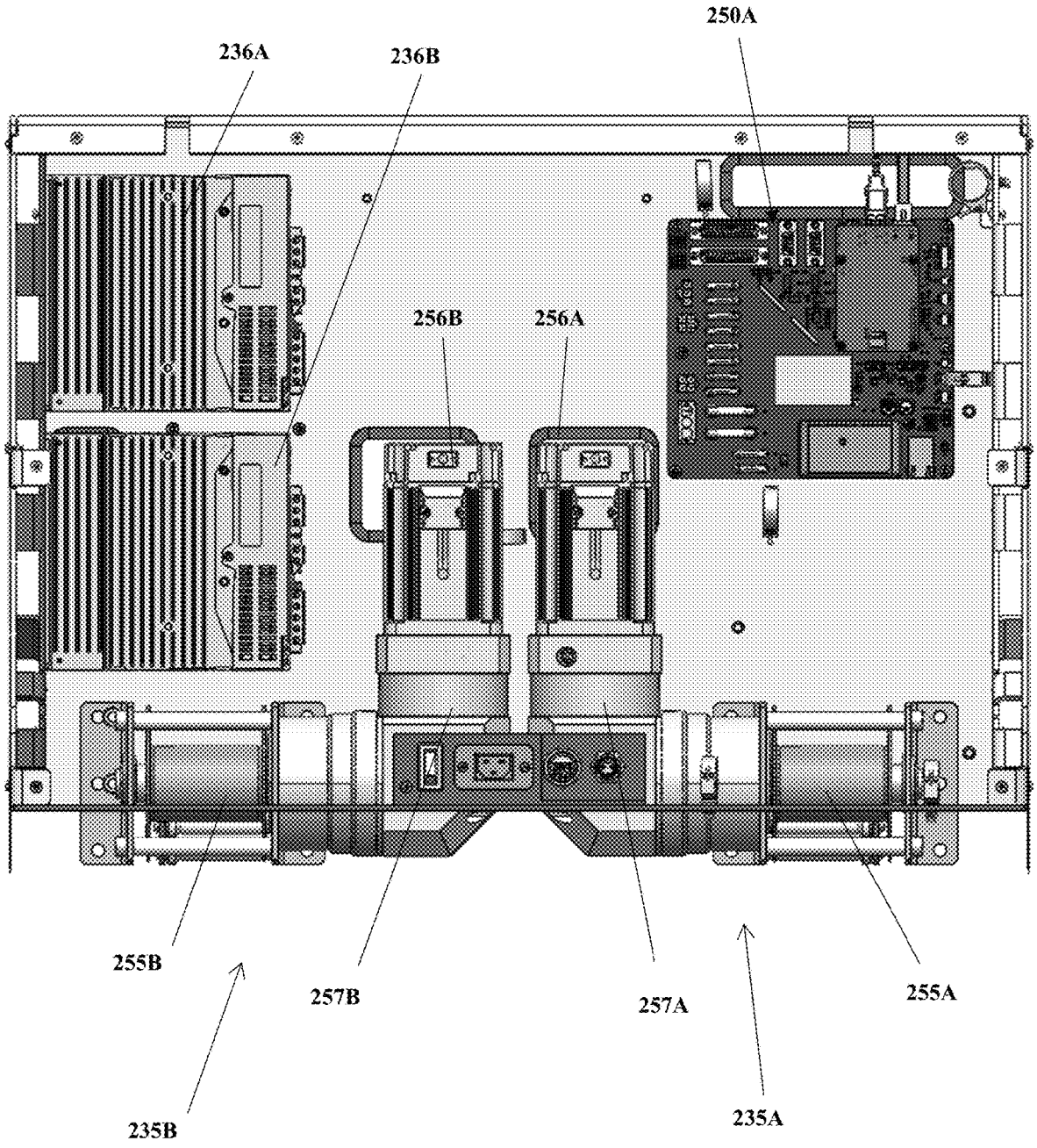
FIG. 20 is a side view of the encoder and the motor systems operable with the controller for the resistance training machine according to one embodiment.

As shown in FIG. 20, the machine controller 250A, the left motor encoder 236A and the right motor encoder 236B are shown operable and connected to the right motor system 235B, the left motor system 235A. The right motor system 235B includes a right motor 255B is connected to a first right angle gearbox 256B and the left motor system 235A includes a left motor 255A and is connected to second right angle gear box 256B. The first right angle gearbox 256B may be operable with a right drive train 257B and the second right angle gearbox may be operably with a left drive train 256B. Right angle gearboxes are characterized by the fact that the drive shaft and the output shaft are arranged at an angle of 90 degrees. Depending on the gearbox type, the axes can intersect in a plane or cross on two parallel planes, which results in an axis offset. Right angle gearboxes are realized with different types of gear teeth or a combination of different gearing types. In other embodiments, alternative gear boxes are used, such a concentric gearbox, an offset gearbox, a parallel gear box. In one embodiment, a single-stage gearbox types are bevel and worm gears. Because of the high single stage ratios and the low efficiency level, worm gears can achieve a self-locking effect. With worm gears it is also possible to have a hollow shaft as the drive shaft. Bevel gearboxes come with different types of gearing. Bevel gearboxes with intersecting axes are realized using bevel gearing with straight, helical or spiral teeth. Hypoid gearboxes have helical bevel gearing with which the axes cross with an axis offset. The bandwidth of technically sensible ratios with which the bevel gear stage can be realized is bigger with hypoid gearboxes than with the classical bevel gear teeth. Bevel gearboxes can also be combined with other gearbox types. A frequent application in this respect is the combination with a planetary gearbox, whereby the planetary gearbox can be connected upstream or downstream. This results in a wide range of overall multiplication factors and wide range of uses in many industrial applications. The efficiency level of bevel gearboxes is typically lower than that of coaxial spur gearboxes, particularly in comparison to planetary gearboxes. This is because the bevel gear stage generates a high degree of axial force and radial force, which has to be absorbed by appropriate bearings. This increases the power loss, which is particularly notable in the drive stage of the gearbox.

The motor encoder may be an AC servo drive with 16-bit high resolution feedback and motor monitor functions. The motor encoder may include a 4-wire high speed serial encoder bus, with 8-bit security code, a graphical interface, Adaptive Tuning Technology, Single/Three-Phase 110~240 VAC±10% 50/60 Hz input, standard Position, Velocity, Torque servo modes; Serial [UART,SPI], Pulse/Sign, CW/CCW, A/B Quadrature, and Analog Command; A/B/Z Quadrature incremental encoder output; Motor Current, Absolute Position, Position Error Monitor Outputs; RS232/Modbus RS485/CAN Communication; and Integrated Point to Point S-curve motion, linear & circular coordinated motion.

Figure 19:
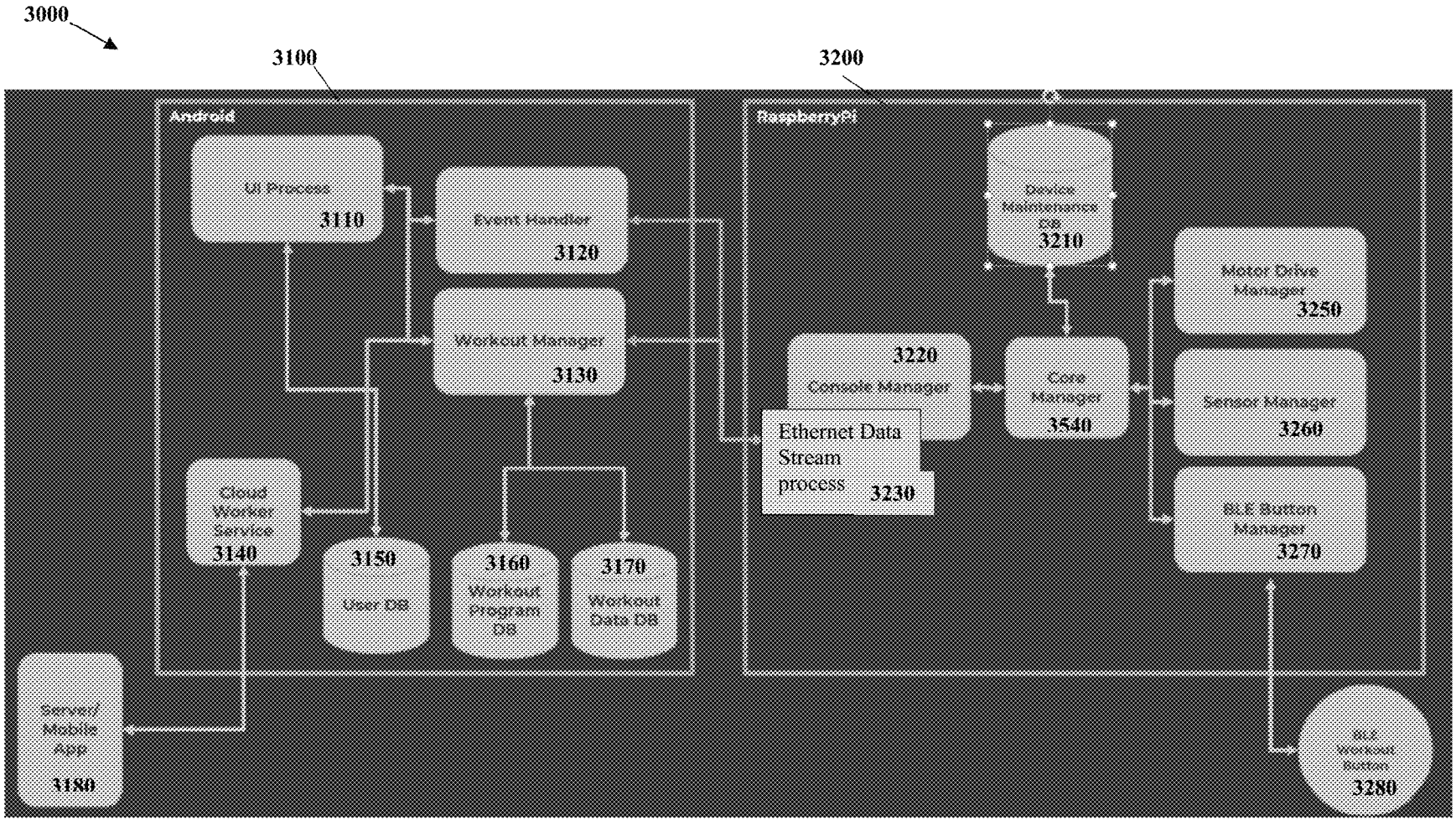
FIG. 19 is a software architecture for the geared-motor resistance machine according to one embodiment.

As shown in FIG. 19, the system software architecture 3000 comprises a first operating system 3100 and a second operating system 3200, which communicate and send and receive data through an API. In one embodiment, the first operating system 3100 is an Android operating system and the second operating system is a Raspberry Pi operation system and both employ computer modules to operate commands, events, and streams based upon sent or received data or protocols. The first operating system 3100 and the second operating system 3200 communicate through a messaging structure and a bi-directional communication scheme utilizing MQTT v3.1.1 in order to exchange information between the first and second operating system, with the MQTT broker running on the second operating system 3200, according to one embodiment. The first operating system 3100 includes a UI process 3110, an Event Handler 3120, a Workout manager 3130, a Cloud Worker service 3140, a user database 3150, a Workout program database 3160, a Workout Data database 3170. The UI process 3110 operably communicates and sends/receives data to the Event Handler 3120, the Workout manager 3130, the Cloud Worker service 3140, and the user database 3150. The Workout manager 3130 sends/receives data to the Cloud Worker service 3140 and the Workout program database 3160, and the Workout Data database 3170. The Cloud Worker service 3140 sends and receives data to a server/mobile application 3180.

The second operating system 3200 includes a device maintenance database 3210, a console manager 3220, an Ethernet data/stream process 3230, a core manager 3540, a motor drive manager 3250, a sensor manager 3260, and a wireless button manager 3270. The device maintenance database 3210 sends and receives data from the core manager 3540. The core manager 3540 sends and receives data from the console manager 3220, the motor drive manager 3250, the sensor manager 3260, and the wireless button manager 3270. The Ethernet data stream process 3230 sends and receives data from the event handler 3120 and the workout manager 3130 from the first operating system 3100. The wireless button manager 3270 sends and receives data from the wireless workout button 3280.

The second operating system 3200 sends commands to the first operating system 3100, which are topics for any particular module. The first operating system 3100 populates events that are processed by the second operating system 3200. The second operating system 3200 processes streams, which are topics continuously populated data stream from the first operating system 3100. The first operating system 3100 and the second operating system 3200 process responses for commands or acknowledgements of data, such as errors or critical events. The first operating system 3100 and the second operating system 3200 provide a Calibration of the resistance training machine, which is the procedure of setting min and max values relative to home position for movement and determines the positions between which the movement takes place. The first operating system 3100 and the second operating system 3200 process Movement Data, which is the process of motor rotation in and out to pull in and release cables between defined positions during calibration or loaded from the database. The second operating system 3200 process data relating to Accessories attached resistance training machine, which are devices which are connected to second operating system 3200 using wireless or Bluetooth, to provide UI control movements and calibration of the motor.

Motor Protocol

The modes that the motor system may implement include a Nemesis Mode, a Standard Mode, an Exocentric Mode, an Isokinetic Mode, an Isotonic Mode, a Concentric mode, an Eccentric Mode. The Nemesis Mode is the movement mode in which the user is able to do an Isokinetic movement in both directions. The Standard Mode is the movement mode in which the user is able to do an Isotonic movement in both directions. The Excentric Mode is the movement mode in which the user is able to do an Isokinetic movement in the eccentric direction. The Isokinetic mode is Constant velocity movement, where the motor is more powerful than the user. The Isotonic Mode is Constant force movement, where the motor is less powerful than the user. The Concentric mode is the upward portion of a movement. The Eccentric mode is the downward portion of a movement. The modes may be set, calibrated, and executed by motor protocols.

The motor protocol is used for both the left and right motor system and the motor protocol is for receiving data from the second operating system about moving status and moving direction for the motor system. The motor protocol is updated on every change in motor movement or change in motor direction. The motor protocol includes a homed protocol, a command protocol, a response protocol, and an error protocol. The homed protocol contains information about the homing status of a motor and updates on change in the home status. The command protocol is used to send commands to the second operating system. The motor command may include: get relative position to home position and get actual position relative to actual home position. The response protocol contains the response data from second operating system and response for each command received by the second operating system. The error protocol is used by the first operating system for receiving error data from motors, for example SDK error, parameters set error, a number of error from list, including motor unexpected stop.

The movement protocol includes a calibration procedure used to establish the movement thresholds to be used during a workout, from where to where the motors will move. The resulting Minimum and Maximum values will be stored by the first operating system and must be passed to the second operating system using a command movement/setMovementData/along with the rest of the movement parameters.

The first operating system sends the communication/movement/calibration/launch Calibration/. The first operating system receives the communication/movement/calibration/calibration Status/. The first operating system sends the/movement/calibration/get Calibration/. The first operating system receives the communication/movement/calibration/actual Calibration/{1 min, 1 max . . . }.

The first operating system will receive several/stream/messages from the second operating system during motor movements approximately every 250 ms. The first operating system will receive from the second operating system all/motor/events, plus/accessories/event/. The first operating system may receive the motor protocol for the right and left motor, the stream, or the accessories events.

The get calibration protocol is used for sending a command to the second operating system and receiving actual calibration data. The second operating system may also request actual calibration from the device.

The actual calibration protocol is used for sending actual calibration from the second operating system to the first operating system, and when EM receive command from API.

The actual calibration protocol may send the minimum point in meters relative to home position for left motor, may send the maximum point in meters relative to home position for left motor, may send the minimum point in meters relative to home position for right motor, and may send the maximum point in meters relative to home position for right motor.

If the machine isn't calibrated, then an invalid calibration value is sent to the second operating system.

The set calibration protocol is used to send calibration values from the first operating system to the second operating system. These values set the calibration minimum and maximum for the motors for the subsequent movement. This set calibration protocol should be used for every movement, or the calibration will be in an invalid state. After setting calibration, the second operating system should use the get calibration protocol to get calibration and check for set values.

The launch calibration protocol is used to send command to the second operating system to launch or stop calibration procedure. The status of calibration can be received in the calibration status protocol.

The calibration status protocol is used to receive info from the second operating system about the calibration status. For example, after sending command launch Calibration protocol. The calibration status protocol may include not calibrated, maximum calibration in progress, maximum calibration completed, minimum calibration in progress, minimum calibration completed, and calibration completed The calibration error protocol is used to receive info from second operating system about calibration error status. For example, after sending command launch calibration protocol.

The set Movement Data protocol is used to set typical movement values. The set movement protocol includes the number of repetitions for movement based on the type of the accessory to process events from the isokinetic, isotonic, eccentric, and mixed modes.

The set movement protocol includes the minimum calibration value for movement in meters for the left side only for isokinetic and mixed modes; the maximum calibration value for movement in meters for the left side only for isokinetic and mixed modes; the minimum calibration value for movement in meters for the right side only for isokinetic and mixed modes; the maximum calibration value for movement in meters for the ride side only for isokinetic and mixed modes; the position for start of movement only for isokinetic and mixed, optionally the top from max point or the bottom for minimum point; which motor is used in movement, optionally left motor system, right motor system, or both motor systems, where calibration uses this value as calibration target; the time for the upward movement; the time for the downward movement only for isokinetic and mixed modes; the force in pounds for the upward movement only for the isotonic mode; the force in pounds for the downward movement only for the isotonic mode.

The movement command protocol is used to send movement commands to the second operating system. To check the status of the movement command protocol, the movement status protocol is used for the response. The movement command protocol includes a start movement, an end movement, a pause movement, and a resume movement.

The movement status protocol is used to receive event status of movement, it also can be a response to the movement command protocol. The movement status protocol is a response and an event, since the movement status can change by both the first and the second operating system (via Bluetooth buttons) interaction. The movement status protocol includes a movement started, a movement paused, a movement resumed, and a movement finished.

The movement error protocol is used by the first operating system to receive an event about movement error. The movement error protocol includes an invalid movement command, a can't start workout due to calibration is not set, an invalid state transition, a hall sensor triggered, and an unable to set movement data.

The movement error acknowledgment is used for send acknowledge about receiving error from the first operating system to the second operating system.

The sensor status protocol is used to receive events about hall sensor status change. The sensor status protocol includes a status of left hall sensor, a status of right hall sensor, a status of motor safety circuit and whether it is enabled or the safety is triggered.

Point to Point Movement (S-Curve)

Max Acceleration, Max Speed, and Gear Number are important data parameters for generating the S-Curve in the motor protocol. The motor drive also applies a smoothing filter to the acceleration profile to generate best S-Curve performance.

The S-Curve profile is calculated as the following,

Gear Ratio=4,096/GEAR NUMBER

Maximum Motor Speed[rpm]=[(MaxSpd+3)*(MaxSpd+3)/16]*12.21*Gear Ratio

Maximum Motor Acceleration[rpm/s]=MaxAcl*635.78*Gear Ratio

Motor Movement Position=Command Position*Gear Ratio*4

Example 1

| Set parameter | Output |
|---|---|
| Gear_Num = 4096 | Gear Ratio = 1 |
| MaxSpd = 48 | Maximum Motor Speed = 1985 rpm |
| MaxAcl = 30 | Maximum Motor Acceleration = 19073 rpm/s |
| Command Position = 140,000 | Motor Movement Position = 560,000 positions |

S-Curve: Acceleration Time=0.104 s; Distance During Acceleration=1.72 rev; Constant Speed Travel Time=0.154 s; Total S-Curve Time=0.362 s.

Accessories

More specifically, the resistance training machine 100 may comprise a number of hardware features which improve its ease of use and its customizability. In the embodiment shown in FIG. 1, the machine 100 may include a safety pedal connected to the platform 102, which provides an emergency stop to the user that may be pressed by a foot or hand. The machine may include at least two wheels 230 located on the platform 102, enabling the machine 100 to be transported over short distances. In some embodiments, the resistance training machine 100 may be self-contained, i.e. may not require any installation with external infrastructure, and may be transportable without attachment or detachment from the floor or walls of a room. In other embodiments, however, the machine 100 may further benefit from external installation, such as through mechanisms (not shown) locking the platform 102 onto the floor or mechanisms mounting the front upright stand 115 against a wall.

Returning now to FIG. 1, the resistance training machine 100 may further comprise a removable bench situated on top of the platform 102. In various embodiments, the bench may be fully detached from the platform 102, or the bench may include one or more locking mechanism (not shown) securing it to the platform 102. The machine 100 may further comprise any number of loose accessories, such as the triangle handle and the straight bar, which may be attached to the left cable 140A and/or the right cable 140B. The accessories may include both dual-cable attachments and single-cable attachments, such as but not limited to curl bars, double handle bars, lat pulldown bars, V-bars, hammer ropes, chinning triangles, close-grip bars, and many others. As previously discussed, in some embodiments, each cable 140 may also terminate in a carabiner, D-ring, or similar locking device to interlock with the various attachments provided.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

The invention claimed is:

1. A resistance training machine comprising:

a base situated parallel to the floor;

a power supply;

a left motor and a right motor, each including an integrated motor encoder and an integrated motor controller;

a left pulley system and a left geared system configured to operatively convert torque from the left motor to a constant force or a constant velocity on a right cable;

a right pulley system and a right geared system configured to operatively convert torque from the right motor to a constant force or a constant velocity on a left cable;

the left cable operatively coupled to the left motor and running through the left pulley system;

the right cable operatively coupled to the right motor and running through the right pulley system;

a machine controller configured to control the left motor and the right motor and to receive position and torque feedback therefrom; and a human machine interface in bi-directional communication with the machine controller;

a left drive belt configured to transfer torque from the left motor to a left drum pulley; and a right drive belt configured to transfer torque from the right motor to a right drum pulley;

wherein the left cable is fixed to the left drum pulley and exits from a left pulley housing located on the base;

wherein the right cable is fixed to the right drum pulley and exits from a right pulley housing located on the base;

a plurality of load cells located in the base and in communication with the machine controller;

wherein a user performs each workout on top of the base;

wherein the load cells operatively supply user balance feedback through the human machine interface;

the machine controller receives position feedback and force feedback from the left motor and the right motor and communicates feedback and balance feedback to the user through the human machine interface;

wherein each of the left motor and the right motor receives a CAN signal or a PWM signal from the integrated motor controller; and wherein each of the left motor and the right motor is capable of independently operating at a constant current, operating at a constant position, operating at a constant velocity, and implementing a received motion profile;

wherein the resistance training machine provide isotonic exercises with the constant force on the right cable and the left cable, provide isokinetic exercises with the constant velocity of the right cable and the left cable, and communicate user form feedback and user balance feedback.

2. The resistance training machine according to claim 1, wherein each of the left motor and the right motor is capable of independently ramping up and ramping down in torque and in RPM; and wherein each of the left motor and the right motor is capable of operating in a follow mode and implementing S-curve motion.

3. The resistance training machine according to claim 2, wherein left motor includes a first right angle gearbox and the right motor includes a second right angle gearbox; wherein the torque generated by the right motor and the left motor is increased by increasing the gear on the first and second right angle gearbox from a lower gear to a higher gear for the constant force, or the torque generated by the right motor and the left motor is decreased by decreasing the gear on the first right angle gearbox and the second right angle gearbox from the higher gear to the lower gear for the constant velocity; and wherein the gear ratio of the lower gear to the higher gear is 1:21, 1:20, 1:19, 1:18, 1:17, 1:16, 1:15, 1:14, 1:13, 1:12, 1:11, 1:10, 1:9, 1:8, 1:7, 1:6, 1:5, 1:4, 1;3, or 1:2.

4. The resistance training machine according to claim 3, wherein the right cable is connected to a right handle and the left cable is connected to a left handle, wherein the constant force is applied to the left handle and the right handle regardless of how fast or slow the user moves the right and left handles during a workout; wherein the constant force includes a maximum force at the right handle and the left handle is about 500 lbs per handle and a maximum velocity at the left handle and the first handle is about 3 ft/0.5 seconds.

5. The resistance training machine according to claim 3, wherein the right cable is connected to a right handle and the left cable is connected to a left handle, wherein the constant velocity is applied to the left handle and the right handle the handle regardless of how much force the user puts on the right and the left handles during; wherein the constant velocity includes a maximum force is about 1000 lbs/handle and a maximum velocity at the left handle and right handle is about 10 inch/1.0 seconds.

6. The resistance training machine according to claim 4, further comprising a left encoder operably coupled to the left motor system and a right encoder operatively coupled to the right motor system; the gear selection from the first right angle system and the second right angle system is controlled by the left motor encoder and the right motor encoder.

7. The resistance training machine according to claim 6, wherein the right motor encoder and the left motor encoder operate under the control of the machine controller, wherein the machine controller comprises a first control system operably communicates with an human machine interface board, a load cell hub, the left motor encoder, the right motor encoder, a Bluetooth module, a power entry module; wherein the load cell hub communicates with zero ball sensors, the Bluetooth module communicates with wireless button, the human machine interface board operably communicates with a user display operating system; the user display operating system operates the display, touch screen, and User Interface (UI); the load cell hub controls and receives input from the load cells in the platform; the wireless button signals start/stop functions to the control system; and the wireless button may operably coupled to the left handle or the right handle; the first control system and the user display operating system operate to control and calibrate the resistance training machine.

8. The resistance training machine according to claim 7, wherein the wireless button includes an emergency stop button to provide the user with an emergency stop feature and stop the left and right motors from pulling on the left cable or the right cable; and the left motor encoder and the right motor encoder are operable with a regen resister.

9. The resistance training machine according to claim 8, further comprising a system software architecture including a first operating system and a second operating system, which communicate and send and receive data through the human machine interface; wherein the first operating system and the second operating system communicate through a messaging structure and a bi-directional communication scheme utilizing in order to exchange information between the first and second operating system; wherein the first operating system includes a UI process, an Event Handler, a Workout manager, a Cloud Worker service, a user database, a Workout program database, a Workout Data database; the UI process operably communicates and sends/receives data to the Event Handler, the Workout manager, the Cloud Worker service, and the user database; the Workout manager sends/receives data to the Cloud Worker service and the Workout program database, and the Workout Data database; and the Cloud Worker service sends and receives data to a server/mobile application.

10. The resistance training machine according to claim 9, wherein the second operating system includes a device maintenance database, a console manager, an Ethernet data/stream process, a core manager, a motor drive manager, a sensor manager, and a wireless button manager; the device maintenance database sends and receives data from the core manager; the core manager sends and receives data from the console manager, the motor drive manager, the sensor manager, and the wireless button manager; the Ethernet data stream process sends and receives data from the event handler and the workout manager from the first operating system; the wireless button manager sends and receives data from the wireless button.

11. The resistance training machine according to claim 10, wherein the second operating system sends commands to the first operating system, which are topics for a particular module; the first operating system populates events that are processed by the second operating system; the second operating system processes streams, which are topics continuously populated data stream from the first operating system; the first operating system and the second operating system process responses for commands or acknowledgements of data, such as errors or critical events; the first operating system and the second operating system provide a Calibration of the resistance training machine, which is the procedure of setting a minimum value and a maximum values relative to home position for movement and determines the positions between which the movement takes place; the first operating system and the second operating system process Movement Data, which is the process of motor rotation in and out to pull in and release cables between defined positions during calibration or loaded from the database; the second operating system process data relating to accessories attached resistance training machine, which are devices which are connected to second operating system using wireless communications and provide UI control movements and calibration of the left motor and the right motor.

12. The resistance training machine according to claim 11, further comprising:

one or more adjustable pulleys attached to the front upright stand and configured to change a direction of force of the left cable and/or the right cable;

a removable bench situated on top of the base;

a front upright stand attached to a front of the base;

an accessory rack attached to the front upright stand; and a plurality of accessories stored on the accessory rack;

wherein the human machine interface is located on the front upright stand and includes both a display and an input mechanism.

13. A method of providing custom workouts using a resistance training machine, comprising the steps of:

calibrating one or more exercises, each including a relative beginning position and a relative end position;

the user selecting an exercise from among the one or more exercises;

the user selecting an isokinetic exercise mode or an isotonic exercise mode;

the user moving a cable to a beginning position without resistance;

a motor and a geared system ramping up the cable to a constant velocity or a constant force, depending on the exercise mode;

the user performing one or more repetitions of the one or more exercises;

the motor and the geared system ramping down the cable from the constant velocity or the constant force, depending on the exercise mode;

the user programming the relative beginning position by extending or retracting the cable to a first position, without resistance, and holding the first position for 2-5 seconds; and the user programming the relative end position by extending or retracting the cable to a second position, without resistance, and holding the second position for 2-5 seconds; wherein each exercise is capable of being recalibrated.

14. The method according to claim 13, further comprising the step of entering a pull in slack mode if:

the cable is not in a docking position; and a force exceeding 500 pounds is exerted on the motor;

a repetition exceeds 10 seconds;

a knob is within 1 inch of the docking position; or no resistance is exerted on the motor for a predetermined period;

wherein during the pull in slack mode:

the motor retracts the cable to the docking position at a minimum force or a minimum velocity; and the motor ceases retracting the cable if resistance is detected.

15. The method according to claim 14, wherein the pull in slack mode is entered if:

the cable is not in a docking position; and one or more load cells operatively detect an unsafe user balance.

16. The method according to claim 13 further comprising the steps of:

the user performing an isokinetic exercise or an isotonic exercise using resistance supplied by the motor and the geared system;

the machine controller receiving position data from the motor throughout the exercise;

the machine controller receiving torque data from the motor throughout the exercise;

the machine controller receiving force data from one or more load cells located in a base of the resistance training machine;

the machine controller generating user form feedback;

the machine controller generating user balance feedback; and displaying the user form feedback and user balance feedback through a human machine interface.

17. The method according to claim 16, further comprising the steps of:

the machine controller generating a visual representation the user form and user balance; and the resistance training machine entering a Non-workout Mode if unsafe user activity is detected.

* * * * *